US011293674B2

(12) United States Patent
Yamada et al.

(10) Patent No.: US 11,293,674 B2
(45) Date of Patent: Apr. 5, 2022

(54) REFRIGERATION APPARATUS WITH MULTIPLE UTILIZATION UNITS AND REFRIGERANT FLOW CONTROL

(71) Applicant: Daikin Industries, LTD., Osaka (JP)

(72) Inventors: Takuro Yamada, Osaka (JP); Yuusuke Nakagawa, Osaka (JP); Yuusuke Oka, Osaka (JP); Masahiro Honda, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 75 days.

(21) Appl. No.: 16/649,767

(22) PCT Filed: Sep. 29, 2017

(86) PCT No.: PCT/JP2017/035696
§ 371 (c)(1),
(2) Date: Mar. 23, 2020

(87) PCT Pub. No.: WO2019/064566
PCT Pub. Date: Apr. 4, 2019

(65) Prior Publication Data
US 2020/0318875 A1 Oct. 8, 2020

(51) Int. Cl.
*F25B 41/20* (2021.01)
*F25B 13/00* (2006.01)
*F25B 49/02* (2006.01)

(52) U.S. Cl.
CPC ..... *F25B 41/20* (2021.01); *F25B 13/00* (2013.01); *F25B 49/02* (2013.01);
(Continued)

(58) Field of Classification Search
CPC ..... F25B 13/00; F25B 2313/0233; F25B 2500/222; F25B 2600/2519; F25B 49/02
See application file for complete search history.

(56) References Cited

U.S. PATENT DOCUMENTS

2004/0139755 A1* 7/2004 Han Park ..... F25B 41/24 62/199
2013/0014525 A1* 1/2013 Koge ..... F24F 1/32 62/126

(Continued)

FOREIGN PATENT DOCUMENTS

CN 105829806 A 8/2016
EP 1443287 A2 8/2004

(Continued)

OTHER PUBLICATIONS

International Search Report issued in corresponding International Application No. PCT/JP2017/035696 dated Dec. 12, 2017 (4 pages).

(Continued)

*Primary Examiner* — Henry T Crenshaw
(74) *Attorney, Agent, or Firm* — Osha Bergman Watanabe & Burton LLP

(57) ABSTRACT

A refrigeration apparatus includes: a heat source unit including a compressor for refrigerant and a heat-source-side heat exchanger; utilization units, each of which is connected in parallel to the heat source unit and includes a utilization-side heat exchanger; a refrigerant-flow-path switching unit that includes first gas-side control valves, each of which switches a flow of refrigerant in a corresponding one of the utilization units, and individually switches a flow of refrigerant in each of the utilization units; a first gas-side connection pipe disposed between the heat source unit and each of the first gas-side control valves and through which high-pressure gas refrigerant flows; first gas-side branch pipes, each of which is included in the first gas-side connection pipe and communicates with a corresponding one of the utilization units; and a blocking valve.

20 Claims, 9 Drawing Sheets

(52) U.S. Cl.
CPC . *F25B 2313/0233* (2013.01); *F25B 2500/222* (2013.01); *F25B 2600/2519* (2013.01)

(56) References Cited

U.S. PATENT DOCUMENTS

| | | | | |
|---|---|---|---|---|
| 2013/0233006 | A1 | 9/2013 | Morimoto et al. | |
| 2015/0233622 | A1* | 8/2015 | Yajima | F25B 49/005 62/129 |
| 2016/0305680 | A1 | 10/2016 | Eguchi et al. | |
| 2016/0356516 | A1 | 12/2016 | Eguchi et al. | |
| 2017/0198946 | A1* | 7/2017 | Takenaka | F25B 41/20 |
| 2019/0234660 | A1* | 8/2019 | Yamada | F25B 49/02 |
| 2020/0011580 | A1* | 1/2020 | Matsuda | F25B 13/00 |

FOREIGN PATENT DOCUMENTS

| | | | |
|---|---|---|---|
| JP | 2004-219061 | A | 8/2004 |
| JP | 2010065992 | A | 3/2010 |
| JP | 2015-114048 | A | 6/2015 |
| JP | 2016 223640 | * | 12/2016 |
| JP | 2016-223640 | A | 12/2016 |
| WO | 2012/101673 | A1 | 8/2012 |

OTHER PUBLICATIONS

International Preliminary Report on Patentability issued in corresponding International Application No. PCT/JP2017/035696 dated Mar. 31, 2020 (11 pages).
Extended European Search Report issued for European Patent Application No. 17927042.6, dated Aug. 12, 2020 (8 pages).

* cited by examiner

REFRIGERATION APPARATUS WITH MULTIPLE UTILIZATION UNITS AND REFRIGERANT FLOW CONTROL

TECHNICAL FIELD

The present invention relates to a refrigeration apparatus.

BACKGROUND

Hitherto, for example, as disclosed in PTL 1 (Japanese Unexamined Patent Application Publication No. 2015-114048), there has been known a refrigeration apparatus that performs a refrigeration cycle in a refrigerant circuit including a heat source unit and a plurality of utilization units connected in parallel. In the refrigeration apparatus, refrigerant pipes extending between the heat source unit and the utilization units each have a control valve that switches a flow of refrigerant. By individually controlling the states of the control valves, directions of refrigerant flows to the individual utilization units are individually switched.

In the above-described refrigeration apparatus, when a refrigerant leak occurs in any one of the utilization units, the corresponding control valve may be controlled to a closed state, thereby reducing the supply of refrigerant to the utilization unit in which the refrigerant leak has occurred and reducing another refrigerant leak.

Meanwhile, in the above-described refrigeration apparatus, for the purpose of collecting refrigeration oil to a compressor, a valve that forms a minute refrigerant flow path (minute flow path) even in a closed state may be adopted as a control valve disposed in a gas-side refrigerant flow path. In such a case, even if the control valve is controlled to a closed state when a refrigerant leak occurs, refrigerant flows via the minute flow path to the utilization unit in which the refrigerant leak has occurred.

There is provided a refrigeration apparatus with increased safety.

SUMMARY

A refrigeration apparatus according to one or more embodiments of the present disclosure invention is a refrigeration apparatus that performs a refrigeration cycle in a refrigerant circuit, and includes a heat source unit, a plurality of utilization units, a refrigerant-flow-path switching unit, a first gas-side connection pipe (or "connection piping"), a plurality of first gas-side branch pipes, and a blocking valve. The heat source unit includes a compressor for refrigerant and a heat-source-side heat exchanger. The plurality of utilization units are connected in parallel to the heat source unit. Each utilization unit includes a utilization-side heat exchanger. The refrigerant-flow-path switching unit includes a plurality of first gas-side control valves. Each first gas-side control valve switches a flow of refrigerant in a corresponding one of the utilization units. The refrigerant-flow-path switching unit individually switches a flow of refrigerant in each of the utilization units. The first gas-side connection pipe is disposed between the heat source unit and each of the first gas-side control valves. The first gas-side connection pipe is a pipe through which high-pressure gas refrigerant flows. The first gas-side branch pipes are included in the first gas-side connection pipe. Each first gas-side branch pipe communicates with a corresponding one of the utilization units. The blocking valve is disposed in the first gas-side connection pipe. The blocking valve blocks a flow of refrigerant when in a closed state. Each first gas-side control valve is disposed in the first gas-side branch pipe that communicates with a corresponding one of the utilization units. The first gas-side connection pipe includes a plurality of branch portions. The branch portions are connected to the first gas-side branch pipes. The blocking valve is disposed between the heat source unit and each of the branch portions.

In the refrigeration apparatus according to one or more embodiments of the present invention, the blocking valve that is disposed in the first gas-side connection pipe and blocks a flow of refrigerant when in a closed state is disposed between the heat source unit and each branch portion. Accordingly, even in a case where a refrigerant leak occurs in a utilization unit, the blocking valve disposed in the first gas-side connection pipe is capable of reducing the supply of refrigerant to the utilization unit. As a result, another refrigerant leak can be reduced. In particular, in a case where the first gas-side control valve is a valve that allows a small amount of refrigerant to pass therethrough when in a closed state (but in a smaller amount compared to the amount of refrigerant that passes in an opened state), another refrigerant leak can be reduced. Accordingly, the safety increases.

In the present invention, the "blocking valve" and the "first gas-side control valve" are controllable valves that can be in a closed state in response to switching of an energization state and are, for example, electric valves or electromagnetic valves.

In the refrigeration apparatus, each of the first gas-side control valves may allow a small amount of refrigerant to pass therethrough when in a closed state.

In the refrigeration apparatus, the blocking valve may be disposed in the refrigerant-flow-path switching unit.

The refrigeration apparatus may further include a control section and a refrigerant leak detecting section. The control section controls an operation of the blocking valve. The refrigerant leak detecting section detects a refrigerant leak in the utilization units. When the refrigerant leak detecting section detects a refrigerant leak (i.e., in response to the refrigerant leak detecting section detecting a refrigerant leak), the control section controls the blocking valve to a closed state. Accordingly, even in a case where a refrigerant leak occurs in a utilization unit, the blocking valve reliably reduces the supply of refrigerant to the utilization unit.

The refrigeration apparatus may further include a liquid-side connection pipe, a plurality of liquid-side branch pipes, and utilization-side control valves. The liquid-side connection pipe is disposed between the heat source unit and the utilization units. The liquid-side connection pipe is a pipe through which refrigerant in a liquid state flows. The liquid-side branch pipes are included in the liquid-side connection pipe. Each liquid-side branch pipe communicates with a corresponding one of the utilization units. Each utilization-side control valve is disposed in one of the utilization units. Each utilization-side control valve communicates with one of the liquid-side branch pipes. The control section further controls states of the utilization-side control valves. When the refrigerant leak detecting section detects a refrigerant leak, the control section controls a corresponding one of the utilization-side control valves to a closed state. Accordingly, even in a case where a refrigerant leak occurs in a utilization unit, the blocking valve and the utilization-side control valve reliably reduce the supply of refrigerant to the utilization unit.

In the present invention, the "refrigerant in a liquid state" includes not only refrigerant in a saturated liquid state or a subcooled state but also refrigerant in a gas-liquid two-phase state. In the present invention, the "utilization-side control valve" is a controllable valve that can be in a closed state in response to switching of an energization state and is, for example, an electric valve or an electromagnetic valve.

The refrigeration apparatus may further include a liquid-side connection pipe and a plurality of liquid-side branch pipes. The liquid-side connection pipe is disposed between the heat source unit and the utilization units. Refrigerant in a liquid state flows through the liquid-side connection pipe. The plurality of liquid-side branch pipes are included in the liquid-side connection pipe. Each liquid-side branch pipe communicates with a corresponding one of the utilization units. The refrigerant-flow-path switching unit includes a plurality of liquid-side control valves. Each liquid-side control valve is disposed in one of the liquid-side branch pipes. Each liquid-side control valve switches a flow of refrigerant in a corresponding one of the utilization units. The control section further controls states of the liquid-side control valves. When the refrigerant leak detecting section detects a refrigerant leak, the control section controls a corresponding one of the liquid-side control valves to a closed state. Accordingly, even in a case where a refrigerant leak occurs in a utilization unit, the blocking valve and the liquid-side control valve reliably reduce the supply of refrigerant to the utilization unit.

In the present invention, the "liquid-side control valve" is a controllable valve that can be in a closed state in response to switching of an energization state and is, for example, an electric valve or an electromagnetic valve.

In the refrigeration apparatus, the control section may further control states of the first gas-side control valves. When the refrigerant leak detecting section detects a refrigerant leak, the control section controls a corresponding one of the first gas-side control valves to a closed state. Accordingly, even in a case where a refrigerant leak occurs in a utilization unit, the blocking valve and the first gas-side control valve reliably reduce the supply of refrigerant to the utilization unit.

In the present invention, the "first gas-side control valve" is a controllable valve that can be in a closed state in response to switching of an energization state and is, for example, an electric valve or an electromagnetic valve.

The refrigeration apparatus may further include a second gas-side connection pipe and a plurality of second gas-side branch pipes. The second gas-side connection pipe is disposed between the heat source unit and the refrigerant-flow-path switching unit. The second gas-side connection pipe is a pipe through which low-pressure gas refrigerant flows. The second gas-side branch pipes are included in the second gas-side connection pipe. Each second gas-side branch pipe communicates with a corresponding one of the utilization units. The refrigerant-flow-path switching unit includes a plurality of second gas-side control valves. Each second gas-side control valve is disposed in one of the second gas-side branch pipes. Each second gas-side control valve switches a flow of refrigerant in a corresponding one of the utilization units. The control section further controls states of the second gas-side control valves. When the refrigerant leak detecting section detects a refrigerant leak, the control section controls a corresponding one of the second gas-side control valves to a closed state. Accordingly, even in a case where a refrigerant leak occurs in a utilization unit, the blocking valve and the second gas-side control valve reliably reduce the supply of refrigerant to the utilization unit.

In the present invention, the "second gas-side control valve" is a controllable valve that can be in a closed state in response to switching of an energization state and is, for example, an electric valve or an electromagnetic valve.

The refrigeration apparatus may further include a bypass mechanism (i.e. "bypass valve"). The bypass mechanism allows refrigerant in the first gas-side connection pipe to flow to a bypass portion provided in another pipe that communicates with the heat source unit. Accordingly, even in a case where the blocking valve is controlled to a closed state, such an increase in pressure of refrigerant in the first gas-side connection pipe as to damage a device or pipe is reduced.

In the refrigeration apparatus, the bypass mechanism may be disposed in a bypass pipe. The bypass pipe is a pipe extending from the first gas-side connection pipe to the bypass portion. The bypass mechanism is a pressure adjusting valve. The pressure adjusting valve opens the bypass pipe when the refrigerant in the first gas-side connection pipe has a pressure higher than or equal to a predetermined reference value. Accordingly, even when the refrigerant in the first gas-side connection pipe has a pressure higher than or equal to the predetermined reference value, the refrigerant in the first gas-side connection pipe is allowed to flow to the bypass portion, and an increase in pressure of the refrigerant in the first gas-side connection pipe to a risky value is reduced.

DETAILED DESCRIPTION

Hereinafter, an air conditioning system 100 (corresponding to a "refrigeration apparatus") according to one or more embodiments of the present invention will be described with reference to the drawings. The following embodiments are specific examples of the present invention, do not limit the technical scope of the present invention, and can be changed as appropriate without deviating from the gist of the present invention.

(1) AIR CONDITIONING SYSTEM 100

Figure 1:
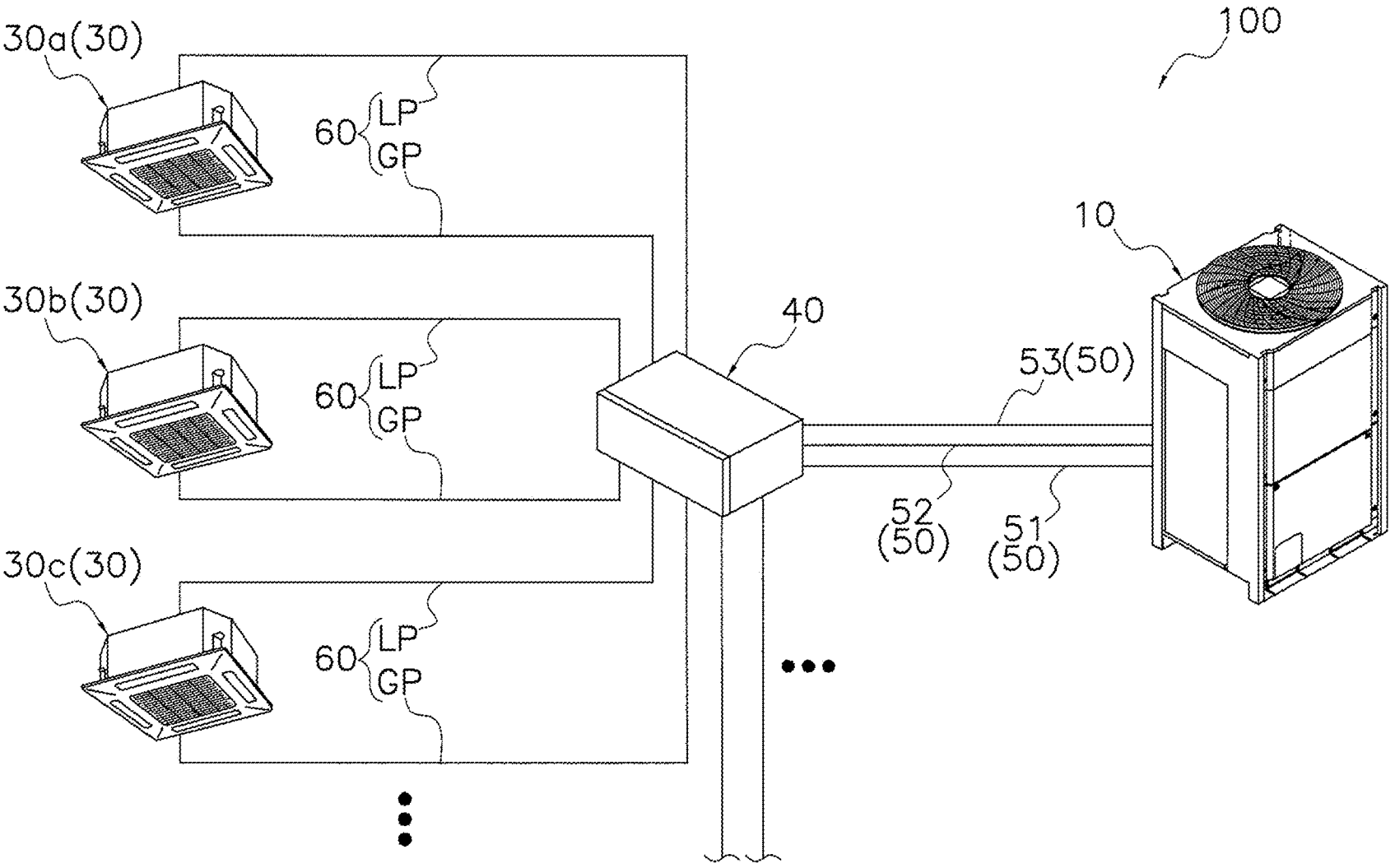
FIG. 1 is an overall configuration diagram of an air conditioning system.

FIG. 1 is an overall configuration diagram of the air conditioning system 100. The air conditioning system 100 is installed in a building, a factory, or the like, and performs air conditioning in a target space. The air conditioning system 100 is an air conditioning system adopting a refrigerant pipe method, and performs a refrigeration cycle in a refrigerant circuit RC to cool or heat the target space.

The air conditioning system 100 mainly includes one outdoor unit 10 serving as a heat source unit, a plurality of indoor units 30 (30*a*, 30*b*, 30*c* . . . ) serving as utilization units, an intermediate unit 40 that switches a flow of refrigerant between the outdoor unit 10 and the individual indoor units 30, outdoor-side connection pipes 50 (a first connection pipe 51, a second connection pipe 52, and a third connection pipe 53) extending between the outdoor unit 10 and the intermediate unit 40, a plurality of indoor-side connection pipes 60 (a liquid-side connection pipe LP and a gas-side connection pipe GP) extending between the indoor units 30 and the intermediate unit 40, a plurality of refrigerant leak sensors 70 that detect a refrigerant leak in the indoor units 30, and a controller 80 that controls the states of individual devices.

In the air conditioning system 100, the intermediate unit 40 is individually associated with each indoor unit 30, and individually switches a flow of refrigerant in each indoor unit 30. Accordingly, in the air conditioning system 100, the operation mode of each indoor unit 30 can be individually switched between a cooling operation and a heating operation or the like. That is, the air conditioning system 100 is of a so-called cooling/heating free type in which a cooling operation or a heating operation can be selected for each indoor unit 30. Each indoor unit 30 receives, via a remote control apparatus that is not illustrated, commands related to switching of various setting items, such as an operation mode and a set temperature.

In the following description, an indoor unit 30 that is performing a cooling operation will be referred to as a "cooling indoor unit 30", an indoor unit 30 that is performing a heating operation will be referred to as a "heating indoor unit 30", and an indoor unit 30 in an operation stop state or an operation suspension state will be referred to as a "suspended indoor unit 30", for the convenience of description.

In the air conditioning system 100, the outdoor unit 10 and the intermediate unit 40 are connected by the outdoor-side connection pipes 50, the intermediate unit 40 and the individual indoor units 30 are connected by the indoor-side connection pipes 60, and accordingly the refrigerant circuit RC is constituted. Specifically, the outdoor unit 10 and the intermediate unit 40 are connected by the first connection pipe 51, the second connection pipe 52, and the third connection pipe 53 serving as the outdoor-side connection pipes 50. Each indoor unit 30 and the intermediate unit 40 are connected by the gas-side connection pipe GP and the liquid-side connection pipe LP serving as the indoor-side connection pipe 60. In other words, the refrigerant circuit RC includes one outdoor unit 10, a plurality of indoor units 30, and one intermediate unit 40.

In the air conditioning system 100, a vapor compression refrigeration cycle is performed in which refrigerant sealed in the refrigerant circuit RC is compressed, cooled or condensed, decompressed, heated or evaporated, and then compressed again. The refrigerant to fill the refrigerant circuit RC is not limited. For example, the refrigerant circuit RC is filled with R32 refrigerant.

In the air conditioning system 100, in the third connection pipe 53 extending between the outdoor unit 10 and the intermediate unit 40, gas-liquid two-phase transport is performed in which refrigerant is transported in a gas-liquid two-phase state. More specifically, under the consideration that an operation can be performed using a smaller amount of refrigerant with a decrease in performance being reduced in a case where refrigerant in a gas-liquid two-phase state is transported in the third connection pipe 53 extending between the outdoor unit 10 and the intermediate unit 40 than in a case where refrigerant in a liquid state is transported therein, the air conditioning system 100 is configured to perform gas-liquid two-phase transport in the third connection pipe 53 to save refrigerant.

In the air conditioning system 100, the operation state thereof shifts to any one of a cooling only state, a heating only state, a cooling main state, a heating main state, and a cooling/heating balanced state during an operation. The cooling only state is a state in which all the indoor units 30 that are operating are cooling indoor units 30 (i.e., all the indoor units 30 that are operating are performing a cooling operation). The heating only state is a state in which all the indoor units 30 that are operating are heating indoor units 30 (i.e., all the indoor units 30 that are operating are performing a heating operation).

The cooling main state is a state in which the heat load of all the cooling indoor units 30 is assumed to be larger than the heat load of all the heating indoor units 30. The heating main state is a state in which the heat load of all the heating indoor units 30 is assumed to be larger than the heat load of all the cooling indoor units 30. The cooling/heating balanced state is a state in which the heat load of all the cooling indoor units 30 and the heat load of all the heating indoor units 30 are assumed to be balanced.

a) Outdoor Unit 10 (Heat Source Unit)

Figure 2:
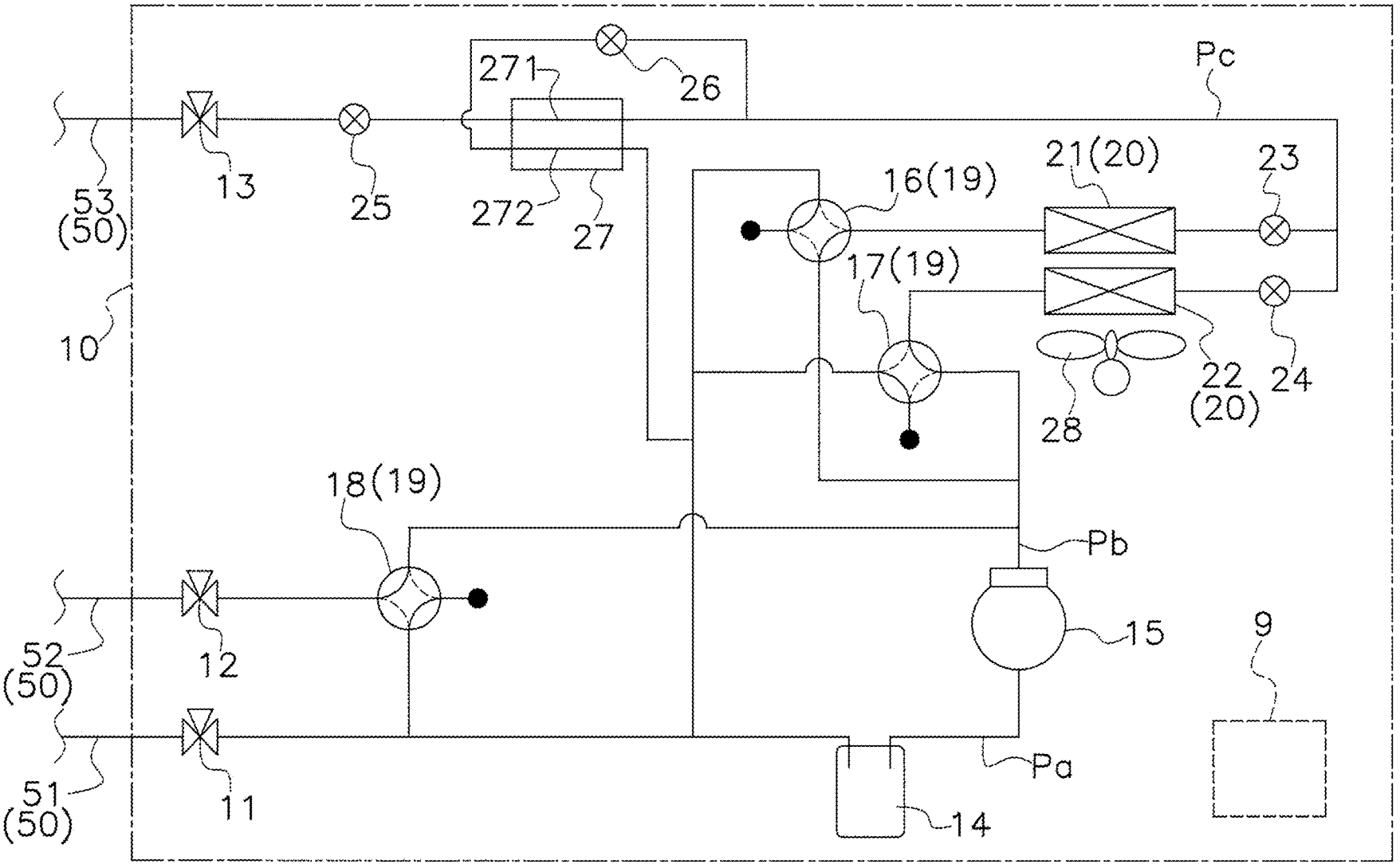
FIG. 2 is a diagram of a refrigerant circuit in the outdoor unit.

FIG. 2 is a diagram of a refrigerant circuit in the outdoor unit 10. The outdoor unit 10 is installed outdoors, for example, on the roof or balcony of a building, or outside a room (outside a target space), such as underground. The outdoor unit 10 mainly includes a first gas-side shutoff valve 11, a second gas-side shutoff valve 12, a liquid-side shutoff valve 13, an accumulator 14, a compressor 15, a first flow-path switching valve 16, a second flow-path switching valve 17, a third flow-path switching valve 18, an outdoor heat exchanger 20, a first outdoor control valve 23, a second outdoor control valve 24, a third outdoor control valve 25, a fourth outdoor control valve 26, and a subcooling heat exchanger 27. In the outdoor unit 10, these devices are disposed in a casing and are connected to each other by refrigerant pipes, and accordingly a part of the refrigerant circuit RC is constituted. In addition, the outdoor unit 10 includes an outdoor fan 28 and an outdoor unit control section 9.

The first gas-side shutoff valve 11, the second gas-side shutoff valve 12, and the liquid-side shutoff valve 13 are manual valves that are opened/closed at the time of filling with refrigerant, pump-down, or the like.

The first gas-side shutoff valve 11 has one end connected to the first connection pipe 51 and has the other end connected to a refrigerant pipe extending to the accumulator 14. The second gas-side shutoff valve 12 has one end connected to the second connection pipe 52 and has the other end connected to a refrigerant pipe extending to the third flow-path switching valve 18. The first gas-side shutoff valve 11 and the second gas-side shutoff valve 12 each function as a port for gas refrigerant (a gas-side port) in the outdoor unit 10.

The liquid-side shutoff valve 13 has one end connected to the third connection pipe 53 and has the other end connected to a refrigerant pipe extending to the third outdoor control valve 25. The liquid-side shutoff valve 13 functions as a port for liquid refrigerant or gas-liquid two-phase refrigerant (liquid-side port) in the outdoor unit 10.

The accumulator 14 is a container for temporarily storing low-pressure refrigerant to be sucked into the compressor 15 and separating the refrigerant into gas and liquid. Inside the accumulator 14, refrigerant in a gas-liquid two-phase state is separated into gas refrigerant and liquid refrigerant. The accumulator 14 is disposed between the first gas-side shutoff valve 11 and the compressor 15 (i.e., on the suction side of the compressor 15). The accumulator 14 has a refrigerant port connected to the refrigerant pipe extending from the first gas-side shutoff valve 11. The accumulator 14 has a refrigerant outlet connected to a suction pipe Pa extending to the compressor 15.

The compressor 15 is a positive-displacement compressor that has an enclosed structure incorporating a compressor motor (not illustrated) and that has a scroll or rotary compression mechanism, for example. In one or more embodiments, only one compressor 15 is provided, but the embodiments are not limited thereto. Two or more compressors 15 may be connected in series or parallel. The compressor 15 has a suction inlet (not illustrated) connected to the suction pipe Pa. The compressor 15 has a discharge outlet (not illustrated) connected to a discharge pipe Pb. The compressor 15 compresses low-pressure refrigerant sucked via the suction pipe Pa and discharges the refrigerant to the discharge pipe Pb.

The compressor 15 communicates with, on the suction side, the intermediate unit 40 via the suction pipe Pa, the accumulator 14, the first gas-side shutoff valve 11, the first connection pipe 51, and so forth. In addition, the compressor 15 communicates with, on the suction side or discharge side, the intermediate unit 40 via the suction pipe Pa, the accumulator 14, the second gas-side shutoff valve 12, the second connection pipe 52, and so forth. In addition, the compressor 15 communicates with, on the discharge side or suction side, the outdoor heat exchanger 20 via the discharge pipe Pb, the first flow-path switching valve 16, the second flow-path switching valve 17, and so forth. That is, the compressor 15 is disposed between the intermediate unit 40 (first control valves 41, second control valves 42) and the outdoor heat exchanger 20.

The first flow-path switching valve 16, the second flow-path switching valve 17, and the third flow-path switching valve 18 (hereinafter, these valves will be collectively referred to as a "flow-path switching valve 19") are four-way switching valves and switch a flow of refrigerant in accordance with a situation (see solid lines and broken lines in the flow-path switching valve 19 in FIG. 2). The flow-path switching valve 19 has a refrigerant port connected to the discharge pipe Pb or a branch pipe extending from the discharge pipe Pb. In addition, the flow-path switching valve 19 is configured such that a flow of refrigerant in one refrigerant flow path is blocked during an operation, and actually functions as a three-way valve. The flow-path switching valve 19 can be switched between a first flow-path state (see the solid lines in the flow-path switching valve 19 in FIG. 2) in which the refrigerant supplied from the discharge side of the compressor 15 (the discharge pipe Pb) supply downstream, and a second flow-path state (see the broken lines in the flow-path switching valve 19 in FIG. 2) in which the flow of refrigerant is shut off.

The first flow-path switching valve 16 is disposed on the refrigerant inlet side/outlet side of a first outdoor heat exchanger 21 (described below) of the outdoor heat exchanger 20. In the first flow-path state, the first flow-path switching valve 16 allows the discharge side of the compressor 15 and the gas-side port of the first outdoor heat exchanger 21 to communicate with each other (see the solid lines in the first flow-path switching valve 16 in FIG. 2). In the second flow-path state, the first flow-path switching valve 16 allows the suction side of the compressor 15 (the accumulator 14) and the gas-side port of the first outdoor heat exchanger 21 to communicate with each other (see the broken lines in the first flow-path switching valve 16 in FIG. 2).

The second flow-path switching valve 17 is disposed on the refrigerant inlet side/outlet side of a second outdoor heat exchanger 22 (described below) of the outdoor heat exchanger 20. In the first flow-path state, the second flow-path switching valve 17 allows the discharge side of the compressor 15 and the gas-side port of the second outdoor heat exchanger 22 to communicate with each other (see the solid lines in the second flow-path switching valve 17 in FIG. 2). In the second flow-path state, the second flow-path switching valve 17 allows the suction side of the compressor 15 (the accumulator 14) and the gas-side port of the second outdoor heat exchanger 22 to communicate with each other (see the broken lines in the second flow-path switching valve 17 in FIG. 2).

In the first flow-path state, the third flow-path switching valve 18 allows the discharge side of the compressor 15 and the second gas-side shutoff valve 12 to communicate with each other (see the solid lines in the third flow-path switching valve 18 in FIG. 2). In the second flow-path state, the third flow-path switching valve 18 allows the suction side of the compressor 15 (the accumulator 14) and the second gas-side shutoff valve 12 to communicate with each other (see the broken lines in the third flow-path switching valve 18 in FIG. 2).

The outdoor heat exchanger 20 (corresponding to the "heat-source-side heat exchanger" described in the claims) is a heat exchanger of a cross-fin type, a stacked type, or the like, and includes a heat transfer tube (not illustrated) through which refrigerant passes. The outdoor heat exchanger 20 functions as a condenser and/or an evaporator for refrigerant in accordance with a flow of the refrigerant. More specifically, the outdoor heat exchanger 20 includes the first outdoor heat exchanger 21 and the second outdoor heat exchanger 22.

The first outdoor heat exchanger 21 has a gas-side refrigerant port connected to a refrigerant pipe connected to the first flow-path switching valve 16, and has a liquid-side refrigerant port connected to a refrigerant pipe extending to the first outdoor control valve 23. The second outdoor heat exchanger 22 has a gas-side refrigerant port connected to a refrigerant pipe connected to the second flow-path switching valve 17, and has a liquid-side refrigerant port connected to a refrigerant pipe extending to the second outdoor control valve 24. Refrigerant that passes through the first outdoor heat exchanger 21 and the second outdoor heat exchanger 22 exchanges heat with an air flow generated by the outdoor fan 28.

The first outdoor control valve 23, the second outdoor control valve 24, the third outdoor control valve 25, and the fourth outdoor control valve 26 are, for example, electric valves whose opening degrees are adjustable. The first outdoor control valve 23, the second outdoor control valve 24, the third outdoor control valve 25, and the fourth outdoor control valve 26 are subjected to opening degree adjustment in accordance with a situation, and decompress the refrigerant passing therethrough or increase/decrease the amount of refrigerant passing therethrough in accordance with the opening degrees.

The first outdoor control valve 23 has one end connected to the refrigerant pipe extending from the first outdoor heat exchanger 21, and has the other end connected to a liquid-side pipe Pc extending to one end of a first flow path 271 (described below) of the subcooling heat exchanger 27. The second outdoor control valve 24 has one end connected to the refrigerant pipe extending from the second outdoor heat exchanger 22, and has the other end connected to the liquid-side pipe Pc extending to the one end of the first flow path 271 of the subcooling heat exchanger 27. The liquid-side pipe Pc has one end that branches off into two pipes, which are individually connected to the first outdoor control valve 23 and the second outdoor control valve 24.

The third outdoor control valve 25 (decompression valve) has one end connected to a refrigerant pipe extending to the other end of the first flow path 271 of the subcooling heat exchanger 27, and has the other end connected to the refrigerant pipe extending to the liquid-side shutoff valve 13. That is, the third outdoor control valve 25 is disposed between the outdoor heat exchanger 20 and the third connection pipe 53. As will be described below, when the operation state of the air conditioning system 100 is any one of the cooling only state, the cooling main state, and the cooling/heating balanced state, the third outdoor control valve 25 is controlled to a two-phase-transport opening degree so that gas-liquid two-phase transport is performed in the third connection pipe 53. The two-phase-transport opening degree is an opening degree for decompressing incoming refrigerant to a pressure for transporting the refrigerant in a gas-liquid two-phase state in the third connection pipe 53. That is, the two-phase-transport opening degree is an opening degree for gas-liquid two-phase transport in the third connection pipe 53.

The fourth outdoor control valve 26 has one end connected to a branch pipe that branches off between both ends of the liquid-side pipe Pc, and has the other end connected to a refrigerant pipe extending to one end of a second flow path 272 (described below) of the subcooling heat exchanger 27.

The subcooling heat exchanger 27 is a heat exchanger for changing refrigerant flowed out of the outdoor heat exchanger 20 into liquid refrigerant in a subcooled state. The subcooling heat exchanger 27 is, for example, a double-pipe heat exchanger. The subcooling heat exchanger 27 is formed of the first flow path 271 and the second flow path 272. More specifically, the subcooling heat exchanger 27 has a structure in which the refrigerant flowing through the first flow path 271 and the refrigerant flowing through the second flow path 272 can exchange heat. The first flow path 271 has one end connected to the other end of the liquid-side pipe Pc, and has the other end connected to the refrigerant pipe extending to the third outdoor control valve 25. The second flow path 272 has one end connected to the refrigerant pipe extending to the fourth outdoor control valve 26, and has the other end connected to a refrigerant pipe extending to the accumulator 14 (more specifically, a refrigerant pipe extending between the accumulator 14 and the first flow-path switching valve 16 or the first gas-side shutoff valve 11).

The outdoor fan 28 is, for example, a propeller fan, and includes an outdoor fan motor (not illustrated) serving as a driving source. Driving of the outdoor fan 28 generates an air flow that flows into the outdoor unit 10, passes through the outdoor heat exchanger 20, and flows out of the outdoor unit 10.

The outdoor unit control section 9 includes a microcomputer constituted by a CPU, a memory, and the like. The outdoor unit control section 9 transmits signals to and receives signals from an indoor unit control section 39 (described below) and an intermediate unit control section 49 (described below) via communication lines (not illustrated). The outdoor unit control section 9 controls the operations and states of various devices included in the outdoor unit 10 (for example, starting/stopping of and the rotation speed of the compressor 15 and the outdoor fan 28, or switching of opening degrees of various valves) in accordance with a situation.

In addition, the outdoor unit 10 includes an outdoor-side sensor 8 (see FIG. 4) that detects a state (pressure or temperature) of refrigerant in the refrigerant circuit RC.

a) Indoor Unit 30 (Utilization Unit)

Figure 3:
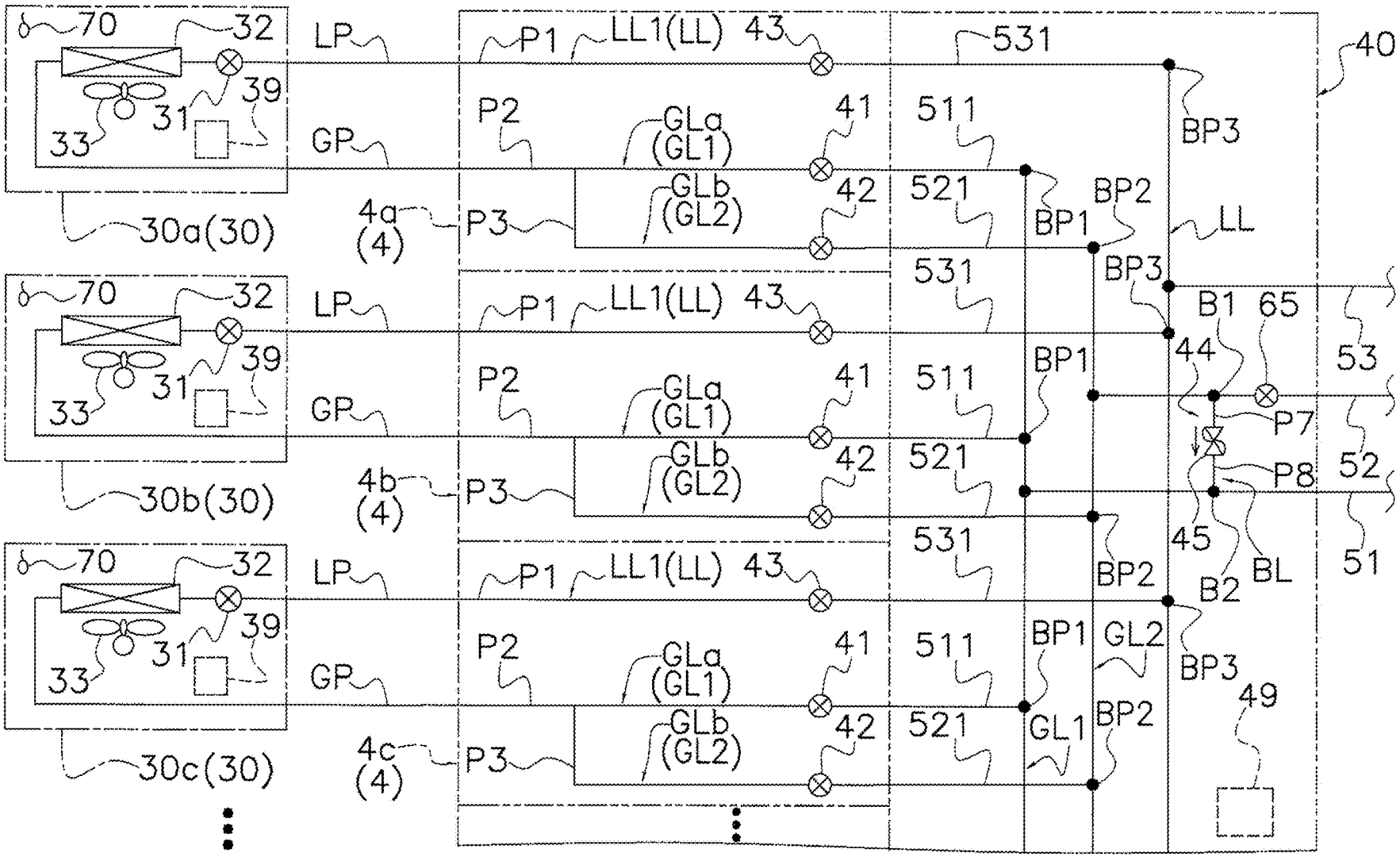
FIG. 3 is a diagram of a refrigerant circuit in indoor units and an intermediate unit.

FIG. 3 is a diagram of a refrigerant circuit in the indoor units 30 and the intermediate unit 40. The type of the indoor units 30 is, although not limited, a ceiling-mounted type of being mounted in a ceiling space, for example. The air conditioning system 100 includes a plurality of (the number is n) indoor units 30 (30*a*, 30*b*, 30*c* . . . ) that are connected in parallel to the outdoor unit 10.

Each indoor unit 30 includes an indoor expansion valve 31 and an indoor heat exchanger 32. In each indoor unit 30, these devices are disposed in a casing and are connected to each other by a refrigerant pipe, thereby constituting a part of the refrigerant circuit RC. In addition, each indoor unit 30 includes an indoor fan 33 and the indoor unit control section 39.

The indoor expansion valve 31 (corresponding to the "utilization-side control valve" described in the claims) is an electric expansion valve whose opening degree is adjustable. The indoor expansion valve 31 is a controllable valve that can be in a closed state in response to switching of an energization state. The indoor expansion valve 31 has one end connected to the liquid-side connection pipe LP, and has the other end connected to a refrigerant pipe extending to the indoor heat exchanger 32. That is, the indoor expansion valve 31 is disposed between the indoor heat exchanger 32 and the third connection pipe 53. In other words, the indoor expansion valve 31 is disposed in a refrigerant flow path between the indoor heat exchanger 32 and a third control valve 43 in the intermediate unit 40. The indoor expansion valve 31 communicates with a liquid-side refrigerant flow path LL (a liquid-side branch pipe 531) described below. The indoor expansion valve 31 decompresses the refrigerant passing therethrough in accordance with the opening degree thereof. In one or more embodiments, when the indoor expansion valve 31 is in a closed state (a minimum opening degree), the indoor expansion valve 31 is in a slightly opened state to form a minute flow path that allows a smaller amount of refrigerant to pass therethrough.

The indoor heat exchanger 32 (corresponding to the "utilization-side heat exchanger" described in the claims) is, for example, a heat exchanger of a cross-fin type, a stacked type, or the like, and includes a heat transfer tube (not illustrated) through which refrigerant passes. The indoor heat exchanger 32 functions as an evaporator or a condenser for refrigerant in accordance with a flow of the refrigerant. The indoor heat exchanger 32 has a liquid-side refrigerant port connected to the refrigerant pipe extending from the indoor expansion valve 31, and has a gas-side refrigerant port connected to the gas-side connection pipe GP. Refrigerant flowed into the indoor heat exchanger 32 exchanges heat with an air flow generated by the indoor fan 33 when passing through the heat transfer tube.

In the indoor heat exchanger 32, switching between the upstream side and the downstream side of refrigerant flowing thereinto, and switching between a state of functioning as an evaporator for refrigerant and a state of functioning as a condenser for refrigerant, are performed in accordance with the states (open/closed states) of the corresponding control valves (41, 42, 43) in the intermediate unit 40, and the states (flow-path states) of the individual flow-path switching valves 19 (16, 17, 18) in the outdoor unit 10.

The indoor fan 33 is, for example, a centrifugal fan, such as a turbofan. The indoor fan 33 includes an indoor fan motor (not illustrated) serving as a driving source. Driving of the indoor fan 33 generates an air flow that flows from a target space into the indoor unit 30, passes through the indoor heat exchanger 32, and flows out to the target space.

The indoor unit control section 39 includes a microcomputer constituted by a CPU, a memory, and the like. The indoor unit control section 39 receives a user instruction via a remote controller (not illustrated) and controls, in response to the instruction, the operations and states of various devices included in the indoor unit 30 (for example, the rotation speed of the indoor fan 33 and the opening degree of the indoor expansion valve 31). In addition, the indoor unit control section 39 is connected to the outdoor unit control section 9 and the intermediate unit control section 49 (described below) by communication lines (not illustrated), and mutually transmits and receives signals. In addition, the indoor unit control section 39 includes a communication module that communicates with the remote controller by wired communication or wireless communication, and mutually transmits a signal to and receives a signal from the remote controller.

In addition, the indoor unit 30 includes an indoor-side sensor 38 (see FIG. 4), such as a temperature sensor that detects a degree of superheating/subcooling of refrigerant passing through the indoor heat exchanger 32, and a temperature sensor that detects a temperature (indoor temperature) of air in a target space taken by the indoor fan 33.

a) Intermediate Unit 40 (Corresponding to the "Refrigerant-Flow-Path Switching Unit" Described in the Claims)

The intermediate unit 40 is disposed between the outdoor unit 10 and the individual indoor units 30, and switches a flow of refrigerant in each indoor unit 30. The intermediate unit 40 includes a plurality of (here, the same number as the number of indoor units 30) switching units 4 (4*a*, 4*b*, 4*c*, . . . ), a pressure adjusting section 44, and a gas-side blocking valve 65. In one or more embodiments, the switching units 4 are associated with the indoor units 30 on a one-to-one basis. That is, the intermediate unit 40 is a unit in which the switching units 4 corresponding to the indoor units 30 on a one-to-one basis are integrated together.

Each switching unit 4 is disposed in a gas-side refrigerant flow path GL (described below) and the liquid-side refrigerant flow path LL (described below) between a corresponding one of the indoor units 30 (hereinafter referred to as a "corresponding indoor unit 30") and the outdoor unit 10, and switches a flow of refrigerant flowing into the corresponding indoor unit 30.

As illustrated in FIG. 3, each switching unit 4 includes a plurality of refrigerant pipes (a first pipe P1 to a third pipe P3) and a plurality of control valves (the first control valve 41, the second control valve 42, and the third control valve 43). In the switching unit 4, these devices are connected to each other by refrigerant pipes, thereby constituting a part of the refrigerant circuit RC.

The first pipe P1 has one end connected to the liquid-side connection pipe LP, and has the other end connected to the third control valve 43. The second pipe P2 has one end connected to the gas-side connection pipe GP, and has the other end connected to the first control valve 41. The third pipe P3 has one end connected between both ends of the second pipe P2, and has the other end connected to the second control valve 42.

Each of the refrigerant pipes (P1, P2, P3) included in the switching unit 4 need not necessarily be formed of one pipe, and may be formed of a plurality of pipes connected by a joint or the like.

The first control valve 41, the second control valve 42, and the third control valve 43 switch between opening/closing of a refrigerant flow path formed between the outdoor unit 10 and the corresponding indoor unit 30, thereby switching the flow of refrigerant in the corresponding indoor unit 30. The first control valve 41, the second control valve 42, and the third control valve 43 are controllable valves that enter a closed state in response to switching of an energization state, and are in one or more embodiments electric valves whose opening degrees are adjustable. The first control valve 41, the second control valve 42, and the third control valve 43 switch a flow of refrigerant by allowing the refrigerant to pass therethrough or by blocking the refrigerant.

The first control valve 41 (corresponding to the "second gas-side control valve" described in the claims) has one end connected to the second pipe P2, and has the other end connected to the first connection pipe 51 (a first branch pipe 511). The first control valve 41 is disposed in a first gas-side branch flow path GLa (the first branch pipe 511) described below, and adjusts the flow rate of the refrigerant flowing through the first gas-side branch flow path GLa in accordance with the opening degree thereof, or switches the flow. That is, the first control valve 41 is disposed in the first gas-side branch flow path GLa (the first branch pipe 511) that communicates with the corresponding indoor unit 30, and switches the flow of refrigerant in the corresponding indoor unit 30. While in a closed state (a minimum opening degree), the first control valve 41 is in a fully-closed state to block a flow of refrigerant.

The second control valve 42 (corresponding to the "first gas-side control valve" described in the claims) has one end connected to the third pipe P3, and has the other end connected to the second connection pipe 52 (a second branch pipe 521). The second control valve 42 is disposed in a second gas-side branch flow path GLb (the second branch pipe 521) described below, and adjusts the flow rate of the refrigerant flowing through the second gas-side branch flow path GLb in accordance with the opening degree thereof, or switches the flow. That is, the second control valve 42 is disposed in the second gas-side branch flow path GLb (the second branch pipe 521) that communicates with the corresponding indoor unit 30, and switches the flow of refrigerant in the corresponding indoor unit 30. In one or more embodiments, the second control valve 42 adopts a valve that forms a minute flow path (i.e., that is in a slightly opened state) allowing a small amount of refrigerant to pass therethrough even in a closed state (a minimum opening degree) for the purpose of collecting refrigeration oil to the compressor 15. Thus, the second control valve 42 allows a small amount of refrigerant to pass therethrough even in a closed state.

The third control valve 43 (corresponding to the "liquid-side control valve" described in the claims) has one end connected to the first pipe P1, and has the other end connected to the third connection pipe 53 (the liquid-side branch pipe 531). The third control valve 43 is disposed in the liquid-side refrigerant flow path LL (the liquid-side branch pipe 531) described below, and adjusts the flow rate of the refrigerant flowing through the liquid-side refrigerant flow path LL in accordance with the opening degree thereof, or switches the flow. That is, the third control valve 43 is disposed in the liquid-side refrigerant flow path LL (the liquid-side branch pipe 531) that communicates with the corresponding indoor unit 30, and switches the flow of refrigerant in the corresponding indoor unit 30. While in a closed state (a minimum opening degree), the third control valve 43 is in a fully-closed state to block a flow of refrigerant.

While the corresponding indoor unit 30 is performing a heating operation, the third control valve 43 of the switching unit 4 is controlled to a two-phase-transport opening degree. Accordingly, the refrigerant that has passed through the indoor heat exchanger 32 of the corresponding indoor unit 30 and has condensed is decompressed when passing through the third control valve 43 and becomes gas-liquid two-phase refrigerant. As a result, the refrigerant passes through the third connection pipe 53 in a gas-liquid two-phase state (i.e., gas-liquid two-phase transport is performed).

While the corresponding indoor unit 30 is performing a cooling operation, the third control valve 43 of the switching unit 4 is controlled to a noise-reduction opening degree. That is, when gas-liquid two-phase transport is performed, the refrigerant is transported in a gas-liquid two-phase state through the liquid-side refrigerant flow path LL (described below) toward the cooling indoor unit 30. However, when the refrigerant passes through the liquid-side connection pipe LP in a gas-liquid two-phase state, noise may occur in accordance with the circulation amount and flow speed of the refrigerant. The third control valve 43 is disposed to reduce the noise. While the corresponding indoor unit 30 is performing a cooling operation, the third control valve 43 is controlled to a predetermined noise-reduction opening degree so as to adjust the circulation amount or flow speed of the refrigerant passing therethrough, thereby reducing noise when the refrigerant passes through the liquid-side connection pipe LP.

The pressure adjusting section 44 is a unit that is disposed at the second connection pipe 52 and that adjusts the pressure of refrigerant in the second connection pipe 52. The pressure adjusting section 44 includes a pressure adjusting valve 45 and bypass pipes (a seventh pipe P7 and an eighth pipe P8) for allowing the refrigerant in the second connection pipe 52 to flow to the first connection pipe 51.

The pressure adjusting valve 45 (corresponding to the "bypass mechanism" described in the claims) has one end connected to the seventh pipe P7, and has the other end connected to the eighth pipe P8. In other words, the pressure adjusting valve 45 is disposed in a bypass pipe (a bypass flow path BL described below).

The pressure adjusting valve 45 opens the bypass pipe (the bypass flow path BL) when the pressure of refrigerant at the one end side thereof (here, the second connection pipe 52 on the seventh pipe P7 side) becomes higher than or equal to a predetermined pressure reference value (a value corresponding to a pressure that may cause damage to the pipes or devices constituting the refrigerant circuit RC). The pressure adjusting valve 45 is a mechanical automatic expansion valve including a pressure sensing mechanism in which a valve disc moves in accordance with a change in pressure applied to the one end side thereof, and operates in accordance with a pressure reference value calculated in advance. In one or more embodiments, the pressure adjusting valve 45 adopts a known general-purpose valve that supports a pressure reference value appropriately selected in accordance with the specifications (capacity, type, and so forth) and the manner of arrangement of the pipes and devices constituting the refrigerant circuit RC.

While a pressure lower than the pressure reference value is applied to the one end side of the pressure adjusting valve 45, the valve disc is maintained at a predetermined position by the elasticity of an elastic body included in the pressure sensing mechanism or the pressure balance of a fluid, and thus the pressure adjusting valve 45 is in a fully closed state to block refrigerant. On the other hand, while a pressure higher than or equal to the predetermined pressure reference value is applied to the one end side of the pressure adjusting valve 45, the valve disc moves in accordance with the pressure, and thus the pressure adjusting valve 45 is in an open state to allow refrigerant to flow therethrough from the one end side toward the other end side. That is, the pressure adjusting valve 45 allows refrigerant to pass therethrough when receiving a pressure higher than or equal to the pressure reference value. The pressure adjusting valve 45 does not operate in accordance with the pressure of refrigerant applied from the other end side (here, the eighth pipe P8 side). In one or more embodiments, when the pressure of the refrigerant in the seventh pipe P7 (more specifically, the pressure of the refrigerant in the second connection pipe 52) becomes higher than or equal to the pressure reference value, the pressure adjusting valve 45 opens the bypass flow path BL to allow the refrigerant in the second connection pipe 52 to flow to the first connection pipe 51 (a second bypass portion B2).

The bypass pipes (P7, P8) are pipes extending from a first bypass portion B1 provided in the second connection pipe 52 to the second bypass portion B2 provided in the first connection pipe 51, and allow refrigerant to flow from the second connection pipe 52 to the first connection pipe 51. The first bypass portion B1 is located, in the second connection pipe 52, between the outdoor unit 10 and individual second gas-side branch portions BP2 (described below). The second bypass portion B2 (corresponding to the "bypass portion" described in the claims) is located, in the first connection pipe 51, between the outdoor unit 10 and individual first gas-side branch portions BP1 (described below).

The seventh pipe P7 has one end connected to the second connection pipe 52, and has the other end connected to the pressure adjusting valve 45. The one end of the seventh pipe P7 is connected to the first bypass portion B1.

The eighth pipe P8 has one end connected to the pressure adjusting valve 45, and has the other end connected to the first connection pipe 51. The other end of the eighth pipe P8 is connected to the second bypass portion B2.

The gas-side blocking valve 65 (corresponding to the "blocking valve" described in the claims) is a controllable valve that enters a closed state in response to switching of an energization state, and is in one or more embodiments, an electric valve whose opening degree is adjustable. The gas-side blocking valve 65 blocks a flow of refrigerant while in a closed state. The gas-side blocking valve 65 is located, in the intermediate unit 40, in the second connection pipe 52, between the outdoor unit 10 and the individual second gas-side branch portions BP2. The gas-side blocking valve 65 is disposed to reduce flowing of refrigerant toward the indoor unit 30 via the second connection pipe 52 when a refrigerant leak occurs in any one of the indoor units 30. That is, as described above, the second control valve 42 of each switching unit 4 that communicates with the second connection pipe 52 allows a small amount of refrigerant to pass therethrough even in a closed state. Thus, even if the second control valve 42 is controlled to a closed state when a refrigerant leak occurs in any one of the indoor units 30, flowing of refrigerant toward the indoor unit 30 is not reliably reduced. The gas-side blocking valve 65 is disposed between the outdoor unit 10 and the individual second control valves 42, so as to reliably reduce flowing of refrigerant toward the indoor unit 30 as necessary.

The intermediate unit 40 includes the intermediate unit control section 49 that controls the states of various devices included in the intermediate unit 40. The intermediate unit control section 49 includes a microcomputer constituted by a CPU, a memory, and the like. The intermediate unit control section 49 receives a signal from the outdoor unit control section 9 or the indoor unit control section 39 via a communication line, and controls, in accordance with a situation, the operations and states of various devices included in the switching units 4 (here, the opening degree of each first control valve 41, each second control valve 42, and each third control valve 43).

a) Outdoor-Side Connection Pipe 50, Indoor-Side Connection Pipe 60

Each outdoor-side connection pipe 50 and each indoor-side connection pipe 60 include a portion that is installed on site by a service person. The length and diameter of each outdoor-side connection pipe 50 and each indoor-side connection pipe 60 are appropriately selected in accordance with an installation environment or design specifications. Each outdoor-side connection pipe 50 and each indoor-side connection pipe 60 extend between the outdoor unit 10 and the switching units 4, or between each switching unit 4 and the corresponding indoor unit 30. Each outdoor-side connection pipe 50 and each indoor-side connection pipe 60 need not necessarily be formed of one pipe, and may be formed of a plurality of pipes connected by a joint, an opening/closing valve, or the like.

The outdoor-side connection pipes 50 (the first connection pipe 51, the second connection pipe 52, and the third connection pipe 53) are disposed between the outdoor unit 10 and the individual indoor units 30.

The first connection pipe 51 (corresponding to the "second gas-side connection pipe" described in the claims) is disposed between the outdoor unit 10 and the individual switching units 4 (more specifically, the first control valves 41). During an operation, the first connection pipe 51 functions as a refrigerant flow path through which low-pressure gas refrigerant flows. The first connection pipe 51 has one end connected to the first gas-side shutoff valve 11, extends toward the indoor units 30 to branch off in accordance with the number of indoor units 30, and is connected to the individual first control valves 41 in the intermediate unit 40. The first connection pipe 51 has the other end that branches off into a plurality of pipes. More specifically, the first connection pipe 51 includes, on the other end side thereof, a plurality of (the same number as the number of indoor units 30) branch portions (the first gas-side branch portions BP1). The first connection pipe 51 includes, at the individual first gas-side branch portions BP1, the first branch pipes 511 (corresponding to the "second gas-side branch pipes" described in the claims) each of which extends toward and communicates with the corresponding indoor unit 30. That is, the first connection pipe 51 includes the plurality of first branch pipes 511 each of which is disposed between the outdoor unit 10 and any one of the indoor units 30 (here, in the switching unit 4). Each first branch pipe 511 has one end connected to the first gas-side branch portion BP1, and has the other end connected to any one of the first control valves 41.

The second connection pipe 52 (corresponding to the "first gas-side connection pipe" described in the claims) is disposed between the outdoor unit 10 and the individual indoor units 30 (more specifically, the second control valves 42 of the individual switching units 4). During an operation, the second connection pipe 52 functions as a refrigerant flow path through which high-pressure gas refrigerant flows when the third flow-path switching valve 18 is in the first flow-path state, and functions as a refrigerant flow path through which low-pressure gas refrigerant flows when the third flow-path switching valve 18 is in the second flow-path state. The second connection pipe 52 has one end connected to the second gas-side shutoff valve 12, extends toward the indoor units 30 to branch off in accordance with the number of indoor units 30, and is connected to the individual second control valves 42 in the intermediate unit 40. The second connection pipe 52 has the other end side that branches off into a plurality of pipes. More specifically, the second connection pipe 52 includes, on the other end side thereof, a plurality of (the same number as the number of indoor units 30) branch portions (the second gas-side branch portions BP2). The second connection pipe 52 includes, at the individual second gas-side branch portions BP2 (corresponding to the "branch portions" described in the claims), the second branch pipes 521 (corresponding to the "first gas-side branch pipes" described in the claims) each of which extends toward and communicates with the corresponding indoor unit 30. That is, the second connection pipe 52 includes the plurality of second branch pipes 521 each of which is disposed between the outdoor unit 10 and any one of the indoor units 30 (here, in the switching unit 4). Each second branch pipe 521 has one end connected to the second gas-side branch portion BP2, and has the other end connected to any one of the second control valves 42.

The third connection pipe 53 (corresponding to the "liquid-side connection pipe" described in the claims) is disposed between the outdoor unit 10 and the individual indoor units 30. During an operation, the third connection pipe 53 functions as a refrigerant flow path through which gas-liquid two-phase refrigerant decompressed by a decompression valve (the third outdoor control valve 25/the third control valve 43) flows. The third connection pipe 53 has one end connected to the liquid-side shutoff valve 13, extends toward the indoor units 30 to branch off in accordance with the number of indoor units 30, and has the other end connected to the individual third control valves 43 in the intermediate unit 40. The third connection pipe 53 has the other end side that branches off into a plurality of pipes. More specifically, the third connection pipe 53 includes, on the other end side thereof, a plurality of (the same number as the number of indoor units 30) branch portions (liquid-side branch portions BP3). The third connection pipe 53 includes, at the individual liquid-side branch portions BP3, the liquid-side branch pipes 531 each of which extends toward and communicates with the corresponding indoor unit 30. That is, the second connection pipe 52 includes the plurality of liquid-side branch pipes 531 each of which is disposed between the outdoor unit 10 and any one of the indoor units 30 (here, in the switching unit 4). Each liquid-side branch pipe 531 has one end connected to the liquid-side branch portion BP3, and has the other end connected to any one of the third control valves 43.

The indoor-side connection pipe 60 (the gas-side connection pipe GP and the liquid-side connection pipe LP) extends between each switching unit 4 and the corresponding indoor unit 30 and connects both of them. Specifically, the gas-side connection pipe GP has one end connected to the second pipe P2, and has the other end connected to the gas-side port of the indoor heat exchanger 32. During an operation, the gas-side connection pipe GP functions as a refrigerant flow path through which gas refrigerant flows. The liquid-side connection pipe LP has one end connected to the first pipe P1, and has the other end connected to the indoor expansion valve 31. During an operation, the liquid-side connection pipe LP functions as a refrigerant flow path through which liquid refrigerant/gas-liquid two-phase refrigerant flows.

a) Refrigerant Leak Sensor 70

The refrigerant leak sensors 70 are sensors for detecting a refrigerant leak in target spaces where the indoor units 30 are disposed (more specifically, in the indoor units 30). In one or more embodiments, a known general-purpose sensor is used as each refrigerant leak sensor 70 in accordance with the type of refrigerant sealed in the refrigerant circuit RC. The refrigerant leak sensors 70 are associated with the indoor units 30 on a one-to-one basis and are disposed in the corresponding indoor units 30.

Each refrigerant leak sensor 70 continuously or intermittently outputs an electric signal corresponding to a detected value (a refrigerant leak sensor detection signal) to the controller 80. More specifically, the refrigerant leak sensor detection signal output from the refrigerant leak sensor 70 has a voltage that varies according to the concentration of refrigerant detected by the refrigerant leak sensor 70. In other words, the refrigerant leak sensor detection signal is output to the controller 80 in such a manner as to specify the concentration of leaked refrigerant in a target space where the refrigerant leak sensor 70 is installed (more specifically, the concentration of refrigerant detected by the refrigerant leak sensor 70) in addition to whether or not there is a refrigerant leak in the refrigerant circuit RC. That is, the refrigerant leak sensor 70 corresponds to a "refrigerant leak detecting section" that detects a refrigerant leak by directly detecting refrigerant (more specifically, the concentration of refrigerant) flowing out of the indoor unit 30.

a) Controller 80 (Corresponding to the "Control Section")

The controller 80 is a computer that controls the state of each device to control the operation of the air conditioning system 100. In one or more embodiments, the controller 80 includes the outdoor unit control section 9, the indoor unit control section 39 in each indoor unit 30, and the intermediate unit control section 49 that are connected by communication lines. The details of the controller 80 will be described below.

(2) REFRIGERANT FLOW PATHS INCLUDED IN REFRIGERANT CIRCUIT RC

The refrigerant circuit RC includes the following plurality of refrigerant flow paths.

(2-1) First Gas-Side Refrigerant Flow Path GL1

The refrigerant circuit RC includes a first gas-side refrigerant flow path GL1 that is disposed between the outdoor unit 10 and the indoor units 30 (i.e., disposed between the outdoor heat exchanger 20 and the individual indoor heat exchangers 32) and through which low-pressure gas refrigerant flows. The first gas-side refrigerant flow path GL1 is a refrigerant flow path formed of the first connection pipe 51, the first control valve 41 and the second pipe P2 of each switching unit 4, and the gas-side connection pipe GP. In one or more embodiments, each switching unit 4 of the intermediate unit 40 is disposed in the first gas-side refrigerant flow path GL1. The first gas-side refrigerant flow path GL1 is disposed between the outdoor unit 10 and the corresponding indoor units 30. The first gas-side refrigerant flow path GL1 extends to branch off into a plurality of flow paths. Specifically, the first gas-side refrigerant flow path GL1 includes a plurality of first gas-side branch flow paths GLa. Each first gas-side branch flow path GLa is disposed between the corresponding indoor unit 30 and the outdoor unit 10.

Each first gas-side branch flow path GLa is formed of the first branch pipe 511, and the first control valve 41 and the second pipe P2 of the switching unit 4. The first gas-side refrigerant flow path GL1 includes the plurality of first gas-side branch portions BP1 serving as starting points of the first gas-side branch flow paths GLa.

(2-2) Second Gas-Side Refrigerant Flow Path GL2

The refrigerant circuit RC includes a second gas-side refrigerant flow path GL2 that is disposed between the outdoor unit 10 and the indoor units 30 (i.e., disposed between the outdoor heat exchanger 20 and the individual indoor heat exchangers 32) and through which low-pressure or high-pressure gas refrigerant flows. The second gas-side refrigerant flow path GL2 is a refrigerant flow path formed of the second connection pipe 52, and the second control valve 42 and the third pipe P3 of each switching unit 4. In one or more embodiments, the switching unit 4 of the intermediate unit 40 is disposed in the second gas-side refrigerant flow path GL2. The second gas-side refrigerant flow path GL2 is disposed between the outdoor unit 10 and the corresponding indoor units 30. The second gas-side refrigerant flow path GL2 extends to branch off into a plurality of flow paths. Specifically, the second gas-side refrigerant flow path GL2 includes a plurality of second gas-side branch flow paths GLb. Each second gas-side branch flow path GLb is disposed between the corresponding indoor unit 30 and the outdoor unit 10.

Each second gas-side branch flow path GLb is formed of the second branch pipe 521, and the second control valve 42 and the third pipe P3 of the switching unit 4. The second gas-side refrigerant flow path GL2 includes the plurality of second gas-side branch portions BP2 serving as starting points of the second gas-side branch flow paths GLb.

(2-3) Liquid-Side Refrigerant Flow Path LL

The refrigerant circuit RC includes a plurality of liquid-side refrigerant flow paths LL that are disposed between the outdoor unit 10 and the indoor units 30 and through which liquid refrigerant (refrigerant in a saturated liquid state or a subcooled state) or gas-liquid two-phase refrigerant flows. The liquid-side refrigerant flow paths LL are refrigerant flow paths formed of the third connection pipe 53, the third control valve 43 and the first pipe P1 of each switching unit 4, and the liquid-side connection pipe LP. In one or more embodiments, the switching units 4 are disposed in the individual liquid-side refrigerant flow paths LL. Each liquid-side refrigerant flow path LL is disposed between the outdoor unit 10 and the corresponding indoor unit 30. The liquid-side refrigerant flow path LL extends to branch off into a plurality of flow paths. Specifically, the liquid-side refrigerant flow path LL includes a plurality of liquid-side branch flow paths LL1. Each liquid-side branch flow path LL1 is disposed between the corresponding indoor unit 30 and the outdoor unit 10. Each liquid-side branch flow path LL1 is formed of the liquid-side branch pipe 531, and the third control valve 43 and the first pipe P1 of the switching unit 4. The liquid-side refrigerant flow path LL includes the plurality of liquid-side branch portions BP3 serving as starting points of the liquid-side branch flow paths LL1.

(2-4) Bypass Flow Path BL

The refrigerant circuit RC includes the bypass flow path BL that is disposed between the first gas-side refrigerant flow path GL1 and the second gas-side refrigerant flow path GL2 and that allows the refrigerant in the second gas-side refrigerant flow path GL2 to flow to the first gas-side refrigerant flow path GL1. The bypass flow path BL is a refrigerant flow path extending from the first bypass portion B1 of the second gas-side refrigerant flow path GL2 to the second bypass portion B2 of the first gas-side refrigerant flow path GL1. The bypass flow path BL is provided for the purpose of, when the refrigerant in the second gas-side refrigerant flow path GL2 has a pressure higher than or equal to a predetermined pressure reference value, reducing the pressure by allowing the refrigerant in the second gas-side refrigerant flow path GL2 to flow to another portion to reduce damage to devices or pipes constituting the second gas-side refrigerant flow path GL2.

The bypass flow path BL includes the seventh pipe P7 and P8 of the pressure adjusting section 44 and the pressure adjusting valve 45. In other words, the bypass flow path BL is a refrigerant flow path formed of the seventh pipe P7 and the eighth pipe P8 of the pressure adjusting section 44, and is opened or blocked by the pressure adjusting valve 45 of the pressure adjusting section 44.

The bypass flow path BL is opened in response to switching of the pressure adjusting valve 45 to an open state when the pressure of the refrigerant flowing through the second gas-side refrigerant flow path GL2 becomes higher than or equal to the pressure reference value. When the bypass flow path BL is open, the refrigerant in the second gas-side refrigerant flow path GL2 is allowed to flow from the first bypass portion B1 of the second gas-side refrigerant flow path GL2 to the second bypass portion B2 of the first gas-side refrigerant flow path GL1 via the bypass flow path BL, and flows through the first connection pipe 51 into the gas-side port of the outdoor unit 10. That is, when the pressure of the refrigerant in the second gas-side refrigerant flow path GL2 becomes higher than or equal to the pressure reference value, the pressure adjusting valve 45 allows the refrigerant in the second gas-side refrigerant flow path GL2 to flow to the second bypass portion B2 via the bypass flow path BL.

(3) FLOW OF REFRIGERANT IN REFRIGERANT CIRCUIT RC

Hereinafter, a flow of refrigerant in the refrigerant circuit RC in each state will be described.

(3-1) Cooling Only State

<A1>

When the air conditioning system 100 is in the cooling only state, refrigerant is sucked into the compressor 15 via the suction pipe Pa and is compressed. The compressed high-pressure gas refrigerant passes through the discharge pipe Pb and the first flow-path switching valve 16 or the second flow-path switching valve 17, and flows into the outdoor heat exchanger 20 (the first outdoor heat exchanger 21 or the second outdoor heat exchanger 22). The refrigerant flowed into the outdoor heat exchanger 20 exchanges heat with the air supplied by the outdoor fan 28 and condenses, when passing through the outdoor heat exchanger 20. The refrigerant passed through the outdoor heat exchanger 20 passes through the first outdoor control valve 23 or the second outdoor control valve 24 and then branches off into two streams while flowing through the liquid-side pipe Pc.

<A2>

One of the two streams of refrigerant branched in the liquid-side pipe Pc flows into the fourth outdoor control valve 26 and is decompressed in accordance with the opening degree of the fourth outdoor control valve 26. The refrigerant passed through the fourth outdoor control valve 26 flows into the second flow path 272 of the subcooling heat exchanger 27, and exchanges heat with the refrigerant passing through the first flow path 271 when passing through the second flow path 272. The refrigerant passed through the second flow path 272 flows into the accumulator 14, and is separated into gas and liquid in the accumulator 14. The gas refrigerant flowed out of the accumulator 14 flows through the suction pipe Pa and is sucked into the compressor 15 again.

<A3>

The other of the two streams of refrigerant branched in the liquid-side pipe Pc flows into the first flow path 271 of the subcooling heat exchanger 27. The refrigerant flowed into the first flow path 271 exchanges heat with the refrigerant passing through the second flow path 272 when passing through the first flow path 271, and becomes subcooled liquid refrigerant. The refrigerant passed through the first flow path 271 flows into the third outdoor control valve 25, is decompressed to a pressure for gas-liquid two-phase transport in accordance with the opening degree of the third outdoor control valve 25, and becomes gas-liquid two-phase refrigerant. The refrigerant passed through the third outdoor control valve 25 passes through the liquid-side shutoff valve 13, flows into the third connection pipe 53 (the liquid-side refrigerant flow path LL), and passes through the third connection pipe 53 in a gas-liquid two-phase state. The refrigerant passed through the third connection pipe 53 flows into the liquid-side branch flow path LL1 and flows into any one of the switching units 4 corresponding to the cooling indoor unit 30.

<A4>

The refrigerant flowed into the switching unit 4 corresponding to the cooling indoor unit 30 flows into the third control valve 43. The refrigerant flowed into the third control valve 43 is decompressed in accordance with the opening degree (noise-reduction opening degree) of the third control valve 43 and then flows into the first pipe P1. The refrigerant passed through the first pipe P1 flows out of the switching unit 4 and flows into the liquid-side connection pipe LP. The refrigerant passed through the liquid-side connection pipe LP flows into the corresponding cooling indoor unit 30. The refrigerant flowed into the cooling indoor unit 30 is decompressed when passing through the indoor expansion valve 31. The refrigerant passed through the indoor expansion valve 31 flows into the indoor heat exchanger 32, exchanges heat with the air supplied by the indoor fan 33 and evaporates when passing through the indoor heat exchanger 32, and becomes superheated gas refrigerant. The refrigerant passed through the indoor heat exchanger 32 flows into the gas-side connection pipe GP. The refrigerant flowing through the gas-side connection pipe GP flows out of the cooling indoor unit 30 and flows into the corresponding switching unit 4.

<A5>

The refrigerant flowed into the switching unit 4 flows through the first gas-side branch flow path GLa or the second gas-side branch flow path GLb and flows out of the switching unit 4. The refrigerant flowed out of the first gas-side branch flow path GLa of the switching unit 4 passes through the first connection pipe 51 and flows into the outdoor unit 10 via the first gas-side shutoff valve 11. The refrigerant flowed out of the second gas-side branch flow path GLb of the switching unit 4 passes through the second connection pipe 52 and flows into the outdoor unit 10 via the second gas-side shutoff valve 12.

<A6>

The refrigerant flowed into the outdoor unit 10 via the first gas-side shutoff valve 11 or the second gas-side shutoff valve 12 flows into the accumulator 14 and is separated into gas and liquid in the accumulator 14. The gas refrigerant flowed out of the accumulator 14 flows through the suction pipe Pa and is sucked into the compressor 15 again.

(3-2) Heating Only State

<B1>

When the air conditioning system 100 is in the heating only state, refrigerant is sucked into the compressor 15 via the suction pipe Pa and is compressed. The compressed high-pressure gas refrigerant passes through the discharge pipe Pb, the third flow-path switching valve 18, and the second gas-side shutoff valve 12, and flows into the second connection pipe 52 (the second gas-side refrigerant flow path GL2).

<B2>

The refrigerant passed through the second connection pipe 52 flows into any one of the switching units 4 corresponding to the heating indoor unit 30. The refrigerant flowed into the switching unit 4 passes through the second gas-side branch flow path GLb and the gas-side connection pipe GP and flows into the heating indoor unit 30.

<B3>

The refrigerant flowed into the heating indoor unit 30 flows into the indoor heat exchanger 32, exchanges heat with the air supplied by the indoor fan 33 and condenses when passing through the indoor heat exchanger 32, and becomes liquid refrigerant or gas-liquid two-phase refrigerant. The refrigerant passed through the indoor heat exchanger 32 passes through the indoor expansion valve 31 and then flows into the liquid-side connection pipe LP. The refrigerant passed through the liquid-side connection pipe LP flows into the corresponding switching unit 4.

<B4>

The refrigerant flowed into the switching unit 4 passes through the first pipe P1 and then flows into the third control valve 43. The refrigerant flowed into the third control valve 43 is decompressed in accordance with the opening degree (two-phase-transport opening degree) of the third control valve 43 and enters a gas-liquid two-phase state. The refrigerant passed through the third control valve 43 flows into the third connection pipe 53. The refrigerant passed through the third connection pipe 53 flows into the outdoor unit 10 via the liquid-side shutoff valve 13.

<B5>

The refrigerant flowed into the outdoor unit 10 via the liquid-side shutoff valve 13 passes through the third outdoor control valve 25 and is decompressed in accordance with the opening degree. The refrigerant passed through the third outdoor control valve 25 flows into the first flow path 271 of the subcooling heat exchanger 27. The refrigerant flowed into the first flow path 271 exchanges heat with the refrigerant passing through the second flow path 272 when passing through the first flow path 271 and becomes subcooled liquid refrigerant. The refrigerant passed through the first flow path 271 branches off into two streams while passing through the liquid-side pipe Pc.

One of the two streams of refrigerant branched in the liquid-side pipe Pc flows in the manner described in the above <A2> and is sucked into the compressor 15 again.

The other of the two streams of refrigerant branched in the liquid-side pipe Pc flows into the first outdoor control valve 23 or the second outdoor control valve 24, and is decompressed in accordance with the opening degree of the first outdoor control valve 23 or the second outdoor control valve 24. The refrigerant passed through the first outdoor control valve 23 or the second outdoor control valve 24 flows into the outdoor heat exchanger 20 (the first outdoor heat exchanger 21 or the second outdoor heat exchanger 22). The refrigerant flowed into the outdoor heat exchanger 20 exchanges heat with the air supplied by the outdoor fan 28 and evaporates when passing through the outdoor heat exchanger 20. The refrigerant passed through the outdoor heat exchanger 20 passes through the first flow-path switching valve 16 or the second flow-path switching valve 17, flows into the accumulator 14, and is separated into gas and liquid in the accumulator 14. The gas refrigerant flowed out of the accumulator 14 flows through the suction pipe Pa and is sucked into the compressor 15 again.

(3-3) Case Where There are Both Cooling Indoor Unit 30 and Heating Indoor Unit 30

A case where there are both the cooling indoor unit 30 and the heating indoor unit 30 will be described for each of the cooling main state, the heating main state, and the cooling/heating balanced state. Regarding the case of the cooling/heating balanced state, a description will be given of a case where the state has been changed from the cooling main state to the cooling/heating balanced state and a case where the state has been changed from the heating main state to the cooling/heating balanced state.

(3-3-1) Case of Being in Cooling Main State

<C1>

In a case where the air conditioning system 100 is in the cooling main state, refrigerant is sucked into the compressor 15 via the suction pipe Pa and is compressed. The compressed high-pressure gas refrigerant branches off into two streams when flowing through the discharge pipe Pb.

<C2>

One of the two streams of refrigerant branched during flowing through the discharge pipe Pb passes through the third flow-path switching valve 18 and the second gas-side shutoff valve 12 and flows into the second connection pipe 52 (the second gas-side refrigerant flow path GL2). The refrigerant flowed into the second connection pipe 52 flows in the manner described in the above <B2> and flows into the heating indoor unit 30. The refrigerant flowed into the heating indoor unit 30 flows in the manner described in the above <B3> and flows into the first pipe P1 of the corresponding switching unit 4. The refrigerant passes through the first pipe P1 and then flows into the third control valve 43. The refrigerant flowed into the third control valve 43 is decompressed in accordance with the opening degree (two-phase-transport opening degree) of the third control valve 43 and enters a gas-liquid two-phase state. The refrigerant passed through the third control valve 43 flows into the third connection pipe 53. The refrigerant flowed into the third connection pipe 53 flows into the third control valve 43 of any one of the switching units 4 corresponding to the cooling indoor unit 30.

<C3>

The refrigerant flowed into the third control valve 43 of any one of the switching units 4 corresponding to the cooling indoor unit 30 flows in the manner described in the above <A4> and flows into the first control valve (the first gas-side branch flow path GLa) of the corresponding switching unit 4. After that, the refrigerant passed through the first control valve of the switching unit 4 passes through the first connection pipe 51 and flows into the outdoor unit 10 via the first gas-side shutoff valve 11. The refrigerant flowed into the outdoor unit 10 via the first gas-side shutoff valve 11 flows in the manner described in the above <A6> and is sucked into the compressor 15 again.

<C4>

On the other hand, the other of the two streams branched during flowing through the discharge pipe Pb in the above <C2> passes through the first flow-path switching valve 16 or the second flow-path switching valve 17 and flows into the outdoor heat exchanger 20 (the first outdoor heat exchanger 21 or the second outdoor heat exchanger 22). The refrigerant flowed into the outdoor heat exchanger 20 exchanges heat with the air supplied by the outdoor fan 28 and condenses, when passing through the outdoor heat exchanger 20. The refrigerant passed through the outdoor heat exchanger 20 passes through the first outdoor control valve 23 or the second outdoor control valve 24 and branches off into two streams while flowing through the liquid-side pipe Pc.

<C5>

One of the two streams of refrigerant branched in the liquid-side pipe Pc flows in the manner described in the above <A2> and is sucked into the compressor 15 again. The other of the two streams of refrigerant branched in the liquid-side pipe Pc flows in the manner described in the above <A3> and flows into the third control valve 43 of any one of the switching units 4 corresponding to the cooling indoor unit 30. The refrigerant flows in the manner described in the above <A4>, evaporates to become gas refrigerant in the indoor unit 30, passes through the gas-side connection pipe GP, and flows into the first gas-side branch flow path GLa of the switching unit 4.

<C6>

The refrigerant flowed into the first gas-side branch flow path GLa of the switching unit 4 flows in the manner described in the above <A5> and flows into the outdoor unit 10 via the second gas-side shutoff valve 12. The refrigerant flowed into the outdoor unit 10 via the second gas-side shutoff valve 12 flows in the manner described in the above <A6> and is sucked into the compressor 15 again.

(3-3-2) Case of Being in Heating Main State

<D1>

In a case where the air conditioning system 100 is in the heating main state, refrigerant is sucked into the compressor 15 via the suction pipe Pa, flows in the manner described in the above <B2>, and flows into the second connection pipe 52. The refrigerant flowed into the second connection pipe 52 flows in the manner described in the above <B2> and flows into the heating indoor unit 30. The refrigerant flowed into the heating indoor unit 30 flows in the manner described in the above <B3> and flows into the first pipe P1 of the corresponding switching unit 4. The refrigerant passes through the first pipe P1 and then flows into the third control valve 43. The refrigerant flowed into the third control valve 43 is decompressed in accordance with the opening degree (two-phase-transport opening degree) of the third control valve 43 and enters a gas-liquid two-phase state. The refrigerant passed through the third control valve 43 flows into the third connection pipe 53.

<D2>

A part of the refrigerant flowed into the third connection pipe 53 flows into the third control valve 43 in any one of the switching units 4 corresponding to the cooling indoor unit 30. The refrigerant flows in the manner described in the above <A4> and flows into the first control valve (the first gas-side branch flow path GLa) of the corresponding switching unit 4. After that, the refrigerant passed through the first control valve of the switching unit 4 flows through the first connection pipe 51 and then flows into the outdoor unit 10 via the first gas-side shutoff valve 11. The refrigerant flowed into the outdoor unit 10 via the first gas-side shutoff valve 11 flows in the manner described in the above <A6> and is sucked into the compressor 15 again.

<D3>

On the other hand, the other part of the refrigerant flowed into the third connection pipe 53 flows into the outdoor unit 10 via the liquid-side shutoff valve 13. The refrigerant flowed into the outdoor unit 10 via the liquid-side shutoff valve 13 flows in the manner described in the above <B5> and is sucked into the compressor 15 again.

(3-3-3) Case of Cooling/Heating Balanced State (3-3-3-1) Case Where State has Been Changed from Cooling Main State to Cooling/Heating Balanced State In a case where the air conditioning system 100 enters the cooling/heating balanced state from the cooling main state, refrigerant flows in the refrigerant circuit RC in the manner described in <C1> to <C6> in "(3-3-1) Case of being in cooling main state".

(3-3-3-2) Case Where State has been Changed from Heating Main State to Cooling/Heating Balanced State

<E1>

In a case where the air conditioning system 100 enters the cooling/heating balanced state from the heating main state, refrigerant is sucked into the compressor 15 via the suction pipe Pa and is compressed. The compressed high-pressure gas refrigerant branches off into two streams when flowing through the discharge pipe Pb.

<E2>

One of the two streams of refrigerant branched during flowing through the discharge pipe Pb flows in the manner described in the above <C2> to <C3> and is sucked into the compressor 15 again.

<E3>

On the other hand, the other of the two streams of refrigerant branched during flowing through the discharge pipe Pb in the above <E2> passes through the discharge pipe Pb and the first flow-path switching valve 16 and flows into the outdoor heat exchanger 20 (the second outdoor heat exchanger 22). The refrigerant flowed into the outdoor heat exchanger 20 exchanges heat with the air supplied by the outdoor fan 28 and condenses, when passing through the outdoor heat exchanger 20. The refrigerant passed through the outdoor heat exchanger 20 passes through the second outdoor control valve 24 and then branches off into two streams while flowing through the liquid-side pipe Pc.

<E4>

One of the two streams of refrigerant branched in the liquid-side pipe Pc flows in the manner described in the above <A2> and is sucked into the compressor 15 again.

<E5>

The other of the two streams of refrigerant branched in the liquid-side pipe Pc flows in the manner described in the above <A3> and flows into the third control valve 43 in any one of the switching units 4 corresponding to the cooling indoor unit 30. The refrigerant flows in the manner described in the above <A4> and flows into the first control valve (the first gas-side branch flow path GLa) of the corresponding switching unit 4. After that, the refrigerant passed through the first control valve of the switching unit 4 passes through the first connection pipe 51 and flows into the outdoor unit 10 via the first gas-side shutoff valve 11. The refrigerant flowed into the outdoor unit 10 via the first gas-side shutoff valve 11 flows in the manner described in the above <A6> and is sucked into the compressor 15 again.

(4) DETAILS OF CONTROLLER 80

Figure 4:
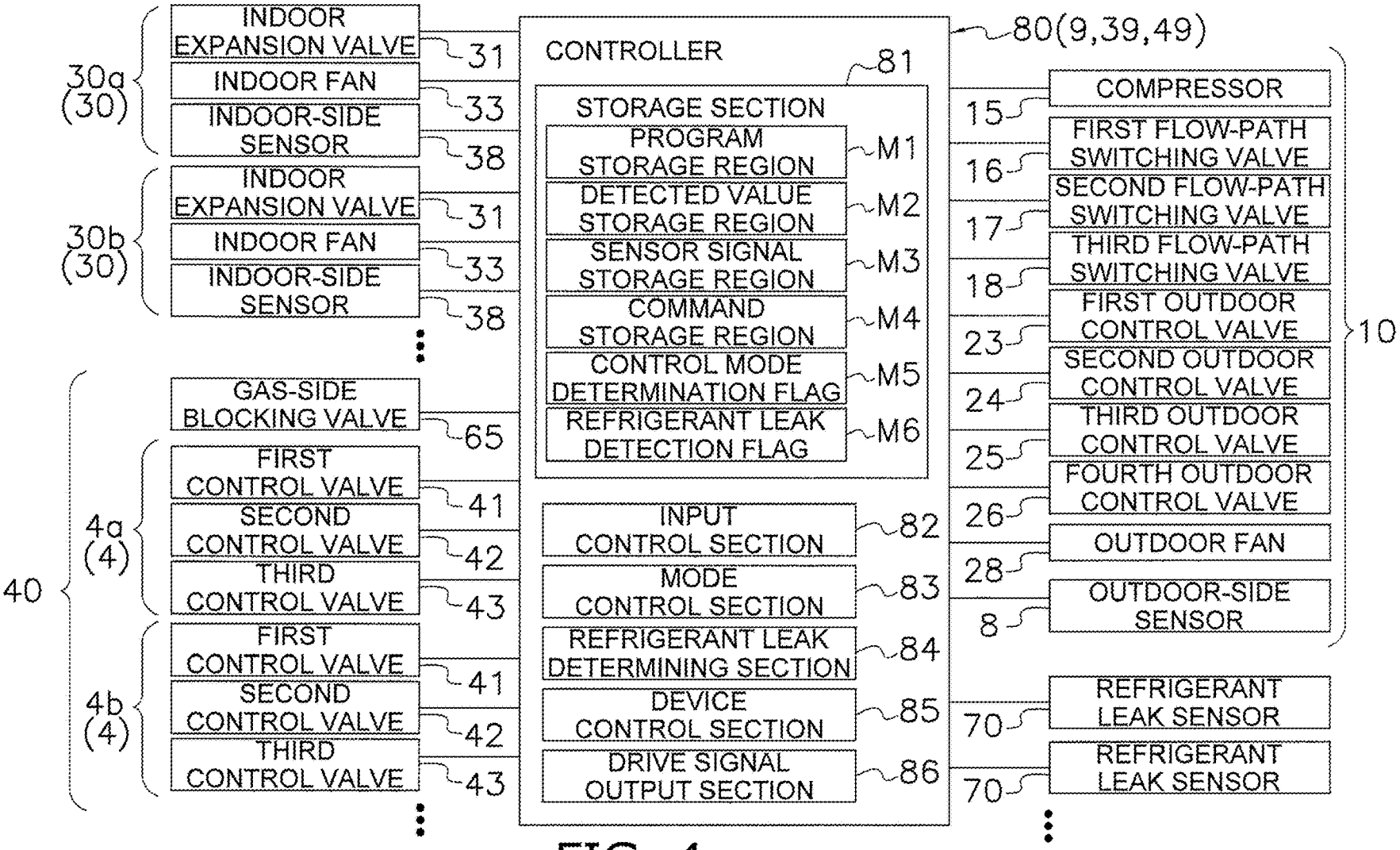
FIG. 4 is a block diagram schematically illustrating a controller and individual devices connected to the controller.

In the air conditioning system 100, the outdoor unit control section 9, the individual indoor unit control sections 39, and the intermediate unit control section 49 are connected by communication lines, thereby constituting the controller 80. FIG. 4 is a block diagram schematically illustrating the controller 80 and the individual devices connected to the controller 80.

The controller 80 has a plurality of control modes and controls the operations of individual devices in accordance with a control mode that is currently set. In one or more embodiments, the controller 80 has, as control modes, a normal operation mode that is set during an operation (in a case where no refrigerant leak has occurred) and a refrigerant leak mode that is set in a case where a refrigerant leak has occurred (more specifically, in a case where leaked refrigerant has been detected).

The controller 80 is electrically connected to the devices included in the air conditioning system 100 (specifically, the compressor 15, the first flow-path switching valve 16, the second flow-path switching valve 17, the third flow-path switching valve 18, the first outdoor control valve 23, the second outdoor control valve 24, the third outdoor control valve 25, the fourth outdoor control valve 26, the outdoor fan 28, and the outdoor-side sensor 8 that are included in the outdoor unit 10; the indoor expansion valve 31, the indoor fan 33, and the indoor-side sensor 38 that are included in each indoor unit 30; each first control valve 41, each second control valve 42, and each third control valve 43 of the intermediate unit 40; each refrigerant leak sensor 70; and so forth).

The controller 80 mainly includes a storage section 81, an input control section 82, a mode control section 83, a refrigerant leak determining section 84, a device control section 85, and a drive signal output section 86. These functional sections in the controller 80 are implemented when the CPU, memory, and various electric/electronic components included in the outdoor unit control section 9, the indoor unit control sections 39, and/or the intermediate unit control section 49 integrally function.

(4-1) Storage Section 81

The storage section 81 is formed of, for example, a ROM, a RAM, a flash memory, and the like, and includes a volatile storage region and a nonvolatile storage region. The storage section 81 includes a program storage region M1 storing a control program that defines processes in the individual sections of the controller 80.

In addition, the storage section 81 includes a detected value storage region M2 for storing detected values of various sensors. The detected value storage region M2 stores, for example, detected values of the outdoor-side sensor 8 and the indoor-side sensors 38 (a suction pressure, a discharge pressure, a suction temperature, and a discharge temperature of the compressor 15, a refrigerant temperature in the outdoor heat exchanger 20, a refrigerant temperature in the indoor heat exchanger 32, or the like).

In addition, the storage section 81 includes a sensor signal storage region M3 for storing a refrigerant leak sensor detection signal transmitted by the refrigerant leak sensor 70 (a detected value of the refrigerant leak sensor 70). The sensor signal storage region M3 has storage regions whose number corresponds to the number of refrigerant leak sensors 70, and a received refrigerant leak sensor detection signal is stored in the region corresponding to the refrigerant leak sensor 70 as a transmission source. The refrigerant leak signal stored in the sensor signal storage region M3 is updated every time a refrigerant leak signal output from the refrigerant leak sensor 70 is received.

In addition, the storage section 81 includes a command storage region M4 for storing a command input via a remote controller or the like that is not illustrated.

In addition, the storage section 81 is provided with a plurality of flags each having a predetermined number of bits. For example, the storage section 81 is provided with a control mode determination flag M5 with which the currently set control mode of the controller 80 can be determined. The control mode determination flag M5 has a number of bits corresponding to the number of control modes, and the bit corresponding to the currently set control mode is set.

In addition, the storage section 81 is provided with a refrigerant leak detection flag M6 for determining that a refrigerant leak in a target space has been detected. More specifically, the refrigerant leak detection flag M6 has a number of bits corresponding to the number of indoor units 30 that are installed, and the bit corresponding to the indoor unit 30 in which a refrigerant leak is assumed to have occurred (refrigerant leak unit) is set. That is, the refrigerant leak detection flag M6 is configured to enable the indoor unit 30 in which a refrigerant leak has occurred to be determined. The refrigerant leak detection flag M6 can be switched by the refrigerant leak determining section 84.

(4-2) Input Control Section 82

The input control section 82 is a functional section functioning as an interface for receiving signals output from the individual devices connected to the controller 80. For example, the input control section 82 receives signals output from the individual sensors (8, 38, 60) or the remote controller, and stores the signals in the corresponding storage regions of the storage section 81, or sets a predetermined flag.

(4-3) Mode Control Section 83

The mode control section 83 is a functional section that switches the control mode. In a normal state (when the refrigerant leak detection flag M6 is not set), the mode control section 83 switches the control mode to the normal operation mode. When the refrigerant leak detection flag M6 is set, the mode control section 83 switches the control mode to the refrigerant leak mode. The mode control section 83 sets the control mode determination flag M5 in accordance with the control mode that is currently set.

(4-4) Refrigerant Leak Determining Section 84

The refrigerant leak determining section 84 is a functional section that determines whether or not a refrigerant leak has occurred in the refrigerant circuit RC. Specifically, when a predetermined refrigerant leak detection condition is satisfied, the refrigerant leak determining section 84 determines that a refrigerant leak has occurred in the refrigerant circuit RC and sets the refrigerant leak detection flag M6.

In one or more embodiments, whether or not the refrigerant leak detection condition is satisfied is determined on the basis of a refrigerant leak sensor detection signal in the sensor signal storage region M3. Specifically, the refrigerant leak detection condition is satisfied in a case where the voltage value related to any refrigerant leak sensor detection signal (the detected value of the refrigerant leak sensor 70) is larger than or equal to a predetermined first reference value for a predetermined period of time t1 or more. The first reference value is a value (concentration of refrigerant) at which a refrigerant leak is assumed to have occurred in the refrigerant circuit RC. The predetermined period of time t1 is set to a period of time in which it can be determined that the refrigerant leak sensor detection signal is not instantaneous. On the basis of the refrigerant leak sensor 70 that has transmitted a refrigerant leak sensor detection signal satisfying the refrigerant leak detection condition, the refrigerant leak determining section 84 specifies a refrigerant leak unit (the indoor unit 30 in which a refrigerant leak is assumed to have occurred), and sets a bit corresponding to the refrigerant leak unit in the refrigerant leak detection flag M6. That is, the refrigerant leak determining section 84 corresponds to a "refrigerant leak detecting section" that individually detects a refrigerant leak in each indoor unit 30, together with each refrigerant leak sensor 70.

The predetermined period of time t1 is appropriately set in accordance with the type of refrigerant sealed in the refrigerant circuit RC, the specifications of individual devices, an installation environment, or the like, and is defined in the control program. The refrigerant leak determining section 84 is configured to be capable of measuring the predetermined period of time t1. The first reference value is appropriately set in accordance with the type of refrigerant sealed in the refrigerant circuit RC, design specifications, an installation environment, and the like, and is defined in the control program.

(4-5) Device Control Section 85

The device control section 85 controls the operations of the individual devices included in the air conditioning system 100 (for example, 15, 16, 17, 18, 23, 24, 25, 26, 28, 31, 33, 41, 42, 43, 60, and so forth) along the control program in accordance with a situation. The device control section 85 refers to the control mode determination flag M5 to determine the control mode that is currently set, and controls the operations of the individual devices on the basis of the determined control mode.

For example, in the normal operation mode, the device control section 85 controls in real time the operation capacity of the compressor 15, the rotation speeds of the outdoor fan 28 and each indoor fan 33, the opening degree and opening/closing of each valve, and so forth, so that an operation is performed in accordance with a set temperature and a detected value or the like of each sensor.

In addition, the device control section 85 performs various types of control described below in accordance with a situation. The device control section 85 is configured to be capable of measuring time.

<First Refrigerant Leak Control>

The device control section 85 performs first refrigerant leak control when it is assumed that a refrigerant leak has occurred in a target space (specifically, when the refrigerant leak detection flag M6 is set). In the first refrigerant leak control, the device control section 85 controls the indoor expansion valve 31 of each indoor unit 30 to a closed state. Accordingly, a flow of refrigerant into the refrigerant leak unit (the indoor unit 30 in which a refrigerant leak has occurred) via the liquid-side refrigerant flow path LL is reduced, and another refrigerant leak is reduced. That is, the first refrigerant leak control is control for reducing the amount of leaked refrigerant in the indoor unit 30 when a refrigerant leak occurs.

<Second Refrigerant Leak Control>

The device control section 85 performs second refrigerant leak control when it is assumed that a refrigerant leak has occurred in a target space (specifically, when the refrigerant leak detection flag M6 is set). In the second refrigerant leak control, the device control section 85 controls the first control valve 41, the second control valve 42, and the third control valve 43 of each switching unit 4 included in the intermediate unit 40 to a closed state. Accordingly, a flow of refrigerant into a refrigerant leak unit (the indoor unit 30 in which a refrigerant leak has occurred) via a refrigerant flow path through which the outdoor unit 10 communicates with each indoor unit 30 is reduced, and another refrigerant leak is reduced. That is, the second refrigerant leak control is control for reducing the amount of leaked refrigerant in the indoor unit 30 when a refrigerant leak occurs.

<Third Refrigerant Leak Control>

The device control section 85 performs third refrigerant leak control when it is assumed that a refrigerant leak has occurred in a target space. In the third refrigerant leak control, the device control section 85 controls the gas-side blocking valve 65 of the intermediate unit 40 to a closed state. As described above, the second control valve 42 disposed in the second gas-side refrigerant flow path GL2 allows a small amount of refrigerant to pass therethrough even when being controlled to a closed state, and thus it is not possible to reliably block the flow of refrigerant from the outdoor unit 10 to the indoor unit 30. Regarding this, to reliably block the flow of refrigerant from the outdoor unit 10 to the indoor unit 30, the gas-side blocking valve 65, which is disposed between the outdoor unit 10 and each second control valve 42, is controlled to a closed state in the third refrigerant leak control. That is, the third refrigerant leak control is control for reliably reducing another refrigerant leak in the indoor unit 30 when a refrigerant leak occurs.

(4-6) Drive Signal Output Section 86

The drive signal output section 86 outputs a corresponding drive signal (drive voltage) to the individual devices (for example, 15, 16, 17, 18, 23, 24, 25, 26, 28, 31, 33, 41, 42, 43, 60, and so forth) in accordance with the details of control by the device control section 85. The drive signal output section 86 includes a plurality of inverters (not illustrated), and outputs a drive signal from a corresponding inverter to a specific device (for example, the compressor 15, the outdoor fan 28, each indoor fan 33, or the like).

(5) PROCEDURE OF PROCESS BY CONTROLLER 80

Figure 5:
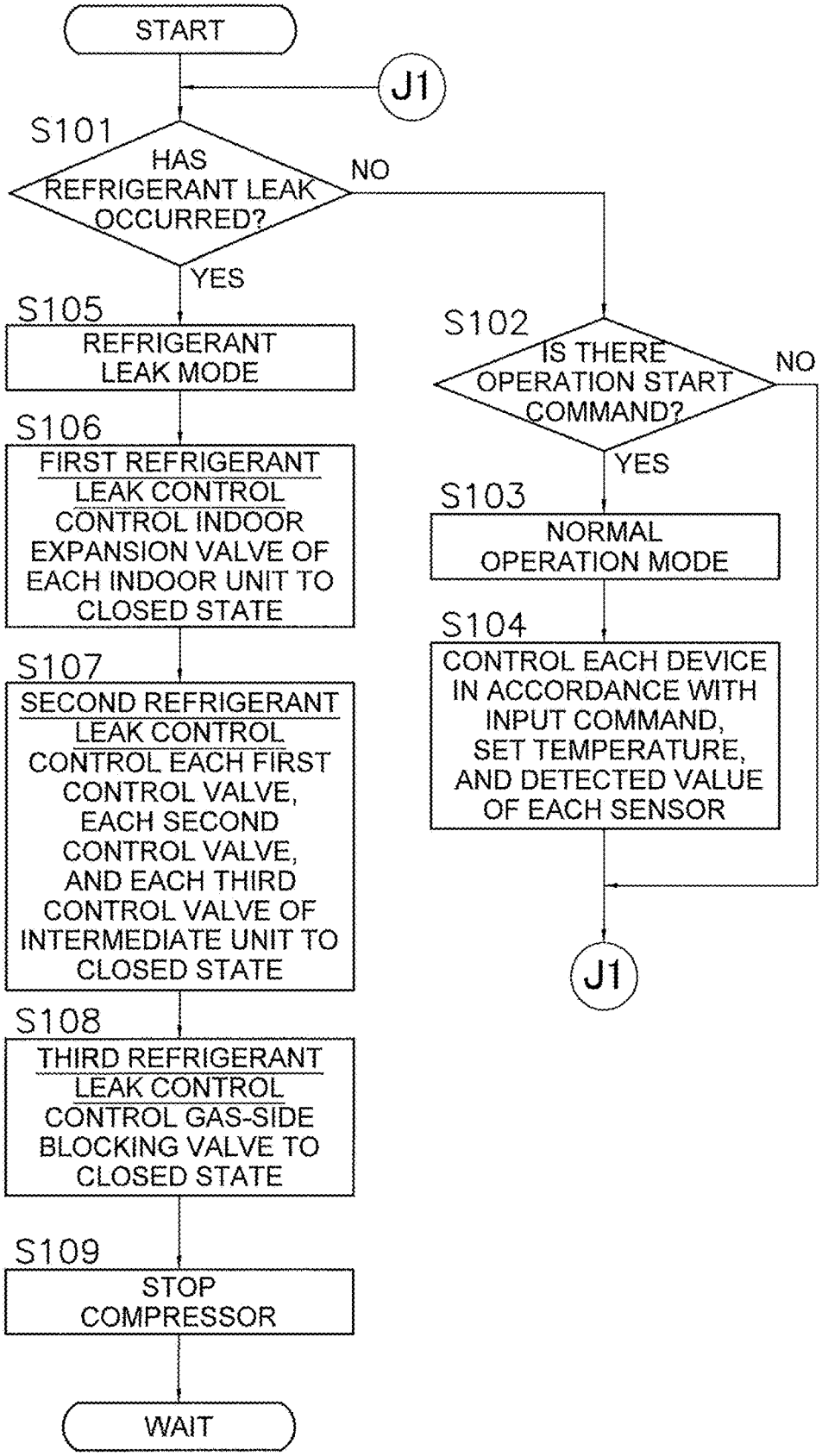
FIG. 5 is a flowchart illustrating an example of a procedure of a process performed by the controller.

Hereinafter, an example of a procedure of a process performed by the controller 80 will be described with reference to FIG. 5. FIG. 5 is a flowchart illustrating an example of a procedure of a process performed by the controller 80. The controller 80 performs the process from step S101 to step S109 in FIG. 5 upon power-on. The procedure of the process illustrated in FIG. 5 is an example and can be changed as appropriate. For example, the order of steps may be changed, a step may be performed in parallel with another step, or another step may be newly added, without causing inconsistency.

In step S101, in a case where it is assumed that a refrigerant leak has occurred in an indoor unit 30 (i.e., in the case of YES), the controller 80 proceeds to step S105. In a case where it is assumed that a refrigerant leak has not occurred in any indoor unit 30 (i.e., in the case of NO), the controller 80 proceeds to step S102.

In step S102, in a case where an operation start command has not been input (i.e., in the case of NO), the controller 80 returns to step S101. On the other hand, in a case where an operation start command has been input (i.e., in the case of YES), the controller 80 proceeds to step S103.

In step S103, the controller 80 shifts to the normal operation mode (or maintains the normal operation mode), and then proceeds to step S104.

In step S104, the controller 80 controls in real time the state of each device in accordance with an input command, a set temperature, a detected value of each sensor (8, 38), and so forth, and then returns to step S101.

In step S105, the controller 80 shifts to the refrigerant leak mode. After that, the controller 80 proceeds to step S106.

In step S106, the controller 80 performs the first refrigerant leak control. Specifically, the controller 80 controls the indoor expansion valve 31 included in each indoor unit 30 to a closed state. Accordingly, a flow of refrigerant into a refrigerant leak unit (the indoor unit 30 in which a refrigerant leak has occurred) via the liquid-side refrigerant flow path LL is reduced, and another refrigerant leak is reduced. After that, the controller 80 proceeds to step S107.

In step S107, the controller 80 performs the second refrigerant leak control. Specifically, the controller 80 controls the first control valve 41, the second control valve 42, and the third control valve 43 of each switching unit 4 included in the intermediate unit 40 to a closed state. Accordingly, a flow of refrigerant into the refrigerant leak unit via a refrigerant flow path through which the outdoor unit 10 communicates with each indoor unit 30 is reduced, and another refrigerant leak is reduced. After that, the controller 80 proceeds to step S108.

In step S108, the controller 80 performs the third refrigerant leak control. Specifically, the controller 80 controls the gas-side blocking valve 65 to a closed state. Accordingly, a flow of refrigerant from the outdoor unit 10 to the indoor unit 30 is reliably blocked. After that, the controller 80 proceeds to step S109.

In step S109, the controller 80 stops the compressor 15. After that, the controller 80 waits until resetting is performed by a manager.

(6) FEATURES 6-1

Hitherto, there has been known a refrigeration apparatus that performs a refrigeration cycle in a refrigerant circuit including a heat source unit and a plurality of utilization units connected in parallel. In the refrigeration apparatus, refrigerant pipes extending between the heat source unit and the utilization units each have a control valve that switches a flow of refrigerant. By individually controlling the states of the control valves, directions of refrigerant flows to the individual utilization units are individually switched. In such a refrigeration apparatus, when a refrigerant leak occurs in any one of the utilization units, the corresponding control valve may be controlled to a closed state, thereby reducing the supply of refrigerant to the utilization unit in which the refrigerant leak has occurred and reducing another refrigerant leak.

Meanwhile, in such a refrigeration apparatus, for the purpose of collecting refrigeration oil to a compressor, a valve that forms a minute refrigerant flow path (minute flow path) even in a closed state may be adopted as a control valve disposed in a gas-side refrigerant flow path. In such a case, even if the control valve is controlled to a closed state when a refrigerant leak occurs, refrigerant flows via the minute flow path to the utilization unit in which the refrigerant leak has occurred.

In contrast, the air conditioning system 100 according to the above-described embodiments has increased safety.

The air conditioning system 100 according to the above-described embodiments is a refrigeration apparatus that performs a refrigeration cycle in the refrigerant circuit RC, and includes: the outdoor unit 10 (corresponding to "heat source unit"); the plurality of indoor units 30 (corresponding to "utilization units"); the intermediate unit 40 (corresponding to "refrigerant-flow-path switching unit"); the second connection pipe 52 (corresponding to "first gas-side connection pipe"); the plurality of second branch pipes 521 (corresponding to "first gas-side branch pipes"); and the gas-side blocking valve 65 (corresponding to "blocking valve"). The outdoor unit 10 includes the compressor 15 for refrigerant and the outdoor heat exchanger 20 (corresponding to "heat-source-side heat exchanger"). The plurality of indoor units 30 are connected in parallel to the outdoor unit 10. Each indoor unit 30 includes the indoor heat exchanger 32 (corresponding to "utilization-side heat exchanger"). The intermediate unit 40 includes the plurality of second control valves 42 (corresponding to "first gas-side control valves"). Each second control valve 42 switches a flow of refrigerant in a corresponding one of the indoor units 30. The intermediate unit 40 individually switches a flow of refrigerant in each of the indoor units 30. The second connection pipe 52 is disposed between the outdoor unit 10 and each of the second control valves 42. The second connection pipe 52 is a pipe through which high-pressure gas refrigerant flows. The second branch pipes 521 are branch pipes included in the second connection pipe 52. Each second branch pipe 521 communicates with a corresponding one of the indoor units 30. The gas-side blocking valve 65 is disposed in the second connection pipe 52. The gas-side blocking valve 65 blocks a flow of refrigerant when in a closed state. Each second control valve 42 is disposed in the second branch pipe 521 that communicates with a corresponding one of the indoor units 30. The second connection pipe 52 includes the plurality of second gas-side branch portions BP2 (corresponding to "branch portions"). The second gas-side branch portions BP2 are connected to the second branch pipes 521. The gas-side blocking valve 65 is disposed between the outdoor unit 10 and each of the second gas-side branch portions BP2.

Accordingly, even in a case where a refrigerant leak occurs in an indoor unit 30, the gas-side blocking valve 65 disposed in the second connection pipe 52 is capable of reducing the supply of refrigerant to the indoor unit 30. As a result, another refrigerant leak can be reduced. In particular, in a case where the second control valve 42 is a valve that allows a small amount of refrigerant to pass therethrough when in a closed state, another refrigerant leak can be reduced. Accordingly, the safety increases.

6-2

In the above-described embodiments, each of the second control valves 42 (corresponding to "first gas-side control valves") is configured to allow a small amount of refrigerant to pass therethrough when in a closed state. Accordingly, collection of refrigeration oil to the compressor 15 is promoted. In particular, when any one of the indoor units 30 is in a stopped state, retention of refrigerant and refrigeration oil in the refrigerant flow path communicating with the indoor unit 30 is reduced, and a decrease in reliability is reduced.

6-3

In the above-described embodiments, the gas-side blocking valve 65 (corresponding to "blocking valve") is disposed in the intermediate unit 40 (corresponding to "refrigerant-flow-path switching unit"). Accordingly, the blocking valve can be easily installed on site, and the workability for installing the blocking valve is increased.

6-4

The air-conditioning system 100 according to the above-described embodiments includes the controller 80 (corresponding to "control section") and the refrigerant leak sensor 70 (corresponding to "refrigerant leak detecting section"). The controller 80 controls an operation of the gas-side blocking valve 65. The refrigerant leak sensor 70 detects a refrigerant leak in the indoor units 30 (corresponding to "utilization units"). When the refrigerant leak sensor 70 detects a refrigerant leak, the controller 80 controls the gas-side blocking valve 65 (corresponding to "blocking valve") to a closed state.

Accordingly, even in a case where a refrigerant leak occurs in an indoor unit 30, the gas-side blocking valve 65 reliably reduces the supply of refrigerant to the indoor unit 30.

6-5

The air-conditioning system 100 according to the above-described embodiments includes the third connection pipe 53 (corresponding to "liquid-side connection pipe") and the plurality of liquid-side branch pipes 531. The third connection pipe 53 is disposed between the outdoor unit 10 (corresponding to "heat source unit") and the indoor units 30 (corresponding to "utilization units"). Refrigerant in a liquid state flows through the third connection pipe 53. The plurality of liquid-side branch pipes 531 are branch pipes included in the third connection pipe 53. Each liquid-side branch pipe 531 communicates with a corresponding one of the indoor units 30. The intermediate unit 40 (corresponding to "refrigerant-flow-path switching unit") includes the plurality of third control valves 43 (corresponding to "liquid-side control valves"). Each third control valve 43 is disposed in one of the liquid-side branch pipes 531. The third control valve 43 switches a flow of refrigerant in a corresponding one of the indoor units 30. The controller 80 (corresponding to "control section") further controls states of the third control valves 43. When the refrigerant leak sensor 70 (corresponding to "refrigerant leak detecting section") detects a refrigerant leak, the controller 80 controls a corresponding one of the third control valves 43 to a closed state.

Accordingly, even in a case where a refrigerant leak occurs in an indoor unit 30, the gas-side blocking valve 65 (corresponding to "blocking valve") and the third control valve 43 reliably reduce the supply of refrigerant to the indoor unit 30.

6-6

In the above-described embodiments, the controller 80 (corresponding to "control section") further controls states of the second control valves 42 (corresponding to "first gas-side control valves"). When the refrigerant leak sensor 70 (corresponding to "refrigerant leak detecting section") detects a refrigerant leak, the controller 80 controls a corresponding one of the second control valves 42 to a closed state.

Accordingly, even in a case where a refrigerant leak occurs in an indoor unit 30 (corresponding to "utilization unit"), the gas-side blocking valve 65 (corresponding to "blocking valve") and the second control valve 42 reliably reduce the supply of refrigerant to the indoor unit 30.

6-7

The air conditioning system 100 according to the above-described embodiments includes the first connection pipe 51 (corresponding to "second gas-side connection pipe") and the plurality of first branch pipes 511 (corresponding to "second gas-side branch pipes"). The first connection pipe 51 is disposed between the outdoor unit 10 and the intermediate unit 40 (corresponding to "refrigerant-flow-path switching unit"). The first connection pipe 51 is a pipe through which low-pressure gas refrigerant flows. The first branch pipes 511 are branch pipes included in the first connection pipe 51. Each first branch pipe 511 communicates with a corresponding one of the indoor units 30 (corresponding to "utilization units"). The intermediate unit 40 includes the plurality of first control valves 41 (corresponding to "second gas-side control valves"). Each first control valve 41 is disposed in one of the first branch pipes 511. The first control valve 41 switches a flow of refrigerant in a corresponding one of the indoor units 30 (corresponding to "utilization units"). The controller 80 (corresponding to "control section") further controls states of the first control valves 41. When the refrigerant leak sensor 70 (corresponding to "refrigerant leak detecting section") detects a refrigerant leak, the controller 80 controls a corresponding one of the first control valves 41 to a closed state.

Accordingly, even in a case where a refrigerant leak occurs in an indoor unit 30, the gas-side blocking valve 65 (corresponding to "blocking valve") and the first control valve 41 reliably reduce the supply of refrigerant to the indoor unit 30.

6-8

In the above-described embodiments, the air conditioning system 100 includes the pressure adjusting valve 45 (corresponding to "bypass mechanism"). The pressure adjusting valve 45 allows refrigerant in the second connection pipe 52 (corresponding to "first gas-side connection pipe") to flow to the second bypass portion B2 provided in the first connection pipe 51 (corresponding to "second gas-side connection pipe") that communicates with the outdoor unit 10.

Accordingly, even in a case where the gas-side blocking valve 65 (corresponding to "blocking valve") is controlled to a closed state, such an increase in pressure of refrigerant in the second connection pipe 52 as to damage a device or pipe is reduced.

6-9

In the above-described embodiments, the pressure adjusting valve 45 is disposed in the bypass pipe (P7, P8). The bypass pipe (P7, P8) is a pipe extending from the second connection pipe 52 (corresponding to "first gas-side connection pipe") to the bypass portion. The pressure adjusting valve 45 functions as the "bypass mechanism". The pressure adjusting valve 45 opens the bypass pipe (P7, P8) when the refrigerant in the second connection pipe 52 has a pressure higher than or equal to a predetermined reference value.

Accordingly, even when the refrigerant in the second connection pipe 52 has a pressure higher than or equal to the predetermined reference value, the refrigerant in the second connection pipe 52 is allowed to flow to the bypass portion, and an increase in pressure of the refrigerant in the second connection pipe 52 to a risky value is reduced.

(7) MODIFICATION EXAMPLES

The above-described embodiments can be appropriately modified as illustrated in the following modification examples. Each modification example may be applied in combination with another modification example within a range not causing inconsistency.

(7-1) First Modification Example

Figure 6:
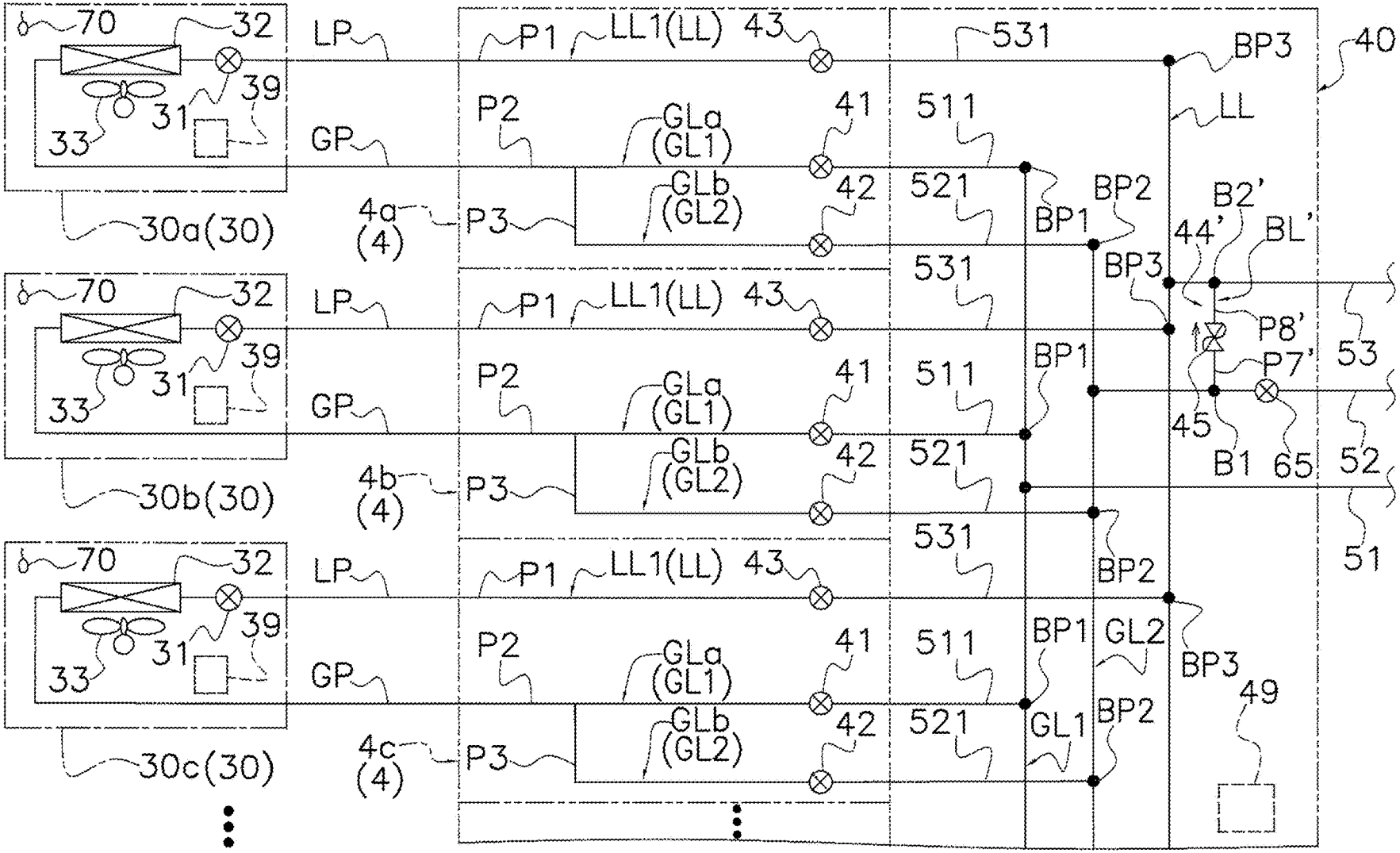
FIG. 6 is a diagram of a refrigerant circuit including a bypass flow path according to a first modification example.

In the air conditioning system 100, a bypass flow path BL' illustrated in FIG. 6 may be disposed together with or instead of the bypass flow path BL according to the above-described embodiments. In FIG. 6, the bypass flow path BL' is formed of bypass pipes (P7' and P8'), and extends from the first bypass portion B1 in the second connection pipe 52 to a second bypass portion B2' (corresponding to the "bypass portion") provided in the third connection pipe 53. In the third connection pipe 53, the second bypass portion B2' is disposed between the outdoor unit 10 and each liquid-side branch portion BP3. Also in a case where the bypass flow path BL' is disposed together with or instead of the bypass flow path BL, a function and effect similar to those in the above-described embodiments can be realized.

(7-2) Second Modification Example

Figure 7:
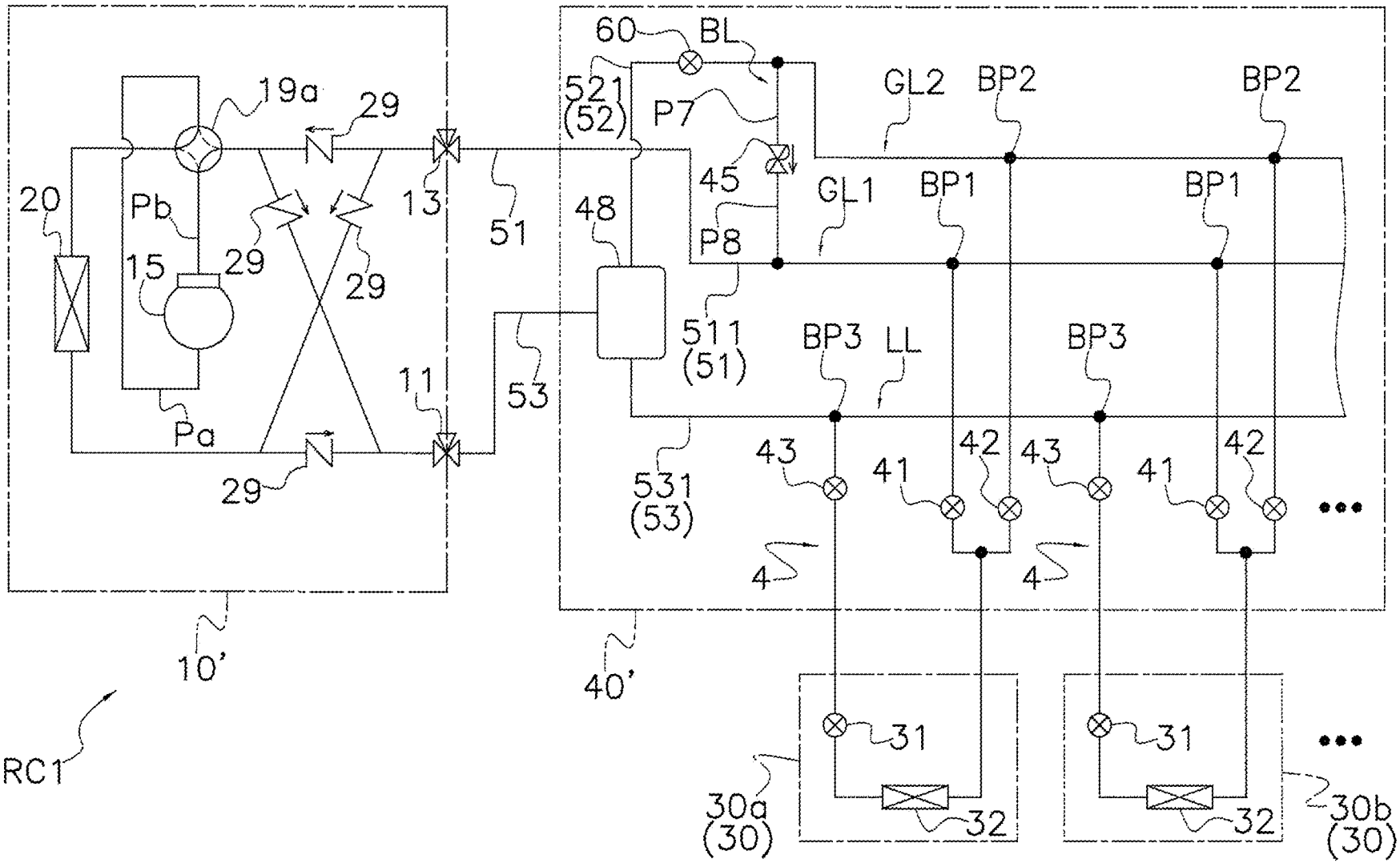
FIG. 7 is a refrigerant circuit diagram according to a second modification example.

In the above-described embodiments, a description has been given of a case where the air conditioning system 100 includes the refrigerant circuit RC, which is a so-called "three-pipe-type" cooling/heating free circuit (a refrigerant circuit in which switching between a cooling operation and a heating operation can be individually performed in each indoor unit 30) in which the outdoor unit 10 and the intermediate unit 40 are connected by three connection pipes (51, 52, 53). However, the outdoor unit 10 and the intermediate unit 40 need not necessarily be connected by the three connection pipes (51, 52, 53). For example, the refrigerant circuit RC may have a configuration of a refrigerant circuit RC1 illustrated in FIG. 7.

The refrigerant circuit RC1 is a "two-pipe-type" cooling/heating free circuit in which an outdoor unit 10 and an intermediate unit 40' are connected by two connection pipes. In the refrigerant circuit RC1, the outdoor unit 10' is disposed instead of the outdoor unit 10. In the outdoor unit 10', devices such as the second gas-side shutoff valve 12, the accumulator 14, each flow-path switching valve 19, and the subcooling heat exchanger 27 are omitted. In addition, in the outdoor unit 10', a four-way switching valve 19*a* is disposed. In addition, in the outdoor unit 10', four check valves 29 are disposed in a bridge pattern.

In addition, in the refrigerant circuit RC1, the intermediate unit 40' is disposed. In the refrigerant circuit RC1, the outdoor unit 10 and the intermediate unit 40' are connected by two connection pipes (the first connection pipe 51 and the third connection pipe 53).

In the intermediate unit 40', a receiver 48 is disposed that stores refrigerant and separates the refrigerant into gas and liquid. The receiver 48 is connected to the second connection pipe 52. The first branch pipe 511 (the first connection pipe 51), the second branch pipe 521 (the second connection pipe 52), and the liquid-side branch pipe 531 (the third connection pipe 53) extend from the receiver 48.

Also with the configuration serving as a "two-pipe-type" cooling/heating free circuit like the refrigerant circuit RC1, a liquid seal circuit is prevented from being configured as in the above-described embodiments.

(7-3) Third Modification Example

In the above-described embodiments, the plurality of switching units 4 are integrated together to form the intermediate unit 40. Alternatively, as in an air conditioning system 100*a* illustrated in FIG. 8 and FIG. 9, the switching units 4 may be separately disposed.

Figure 8:
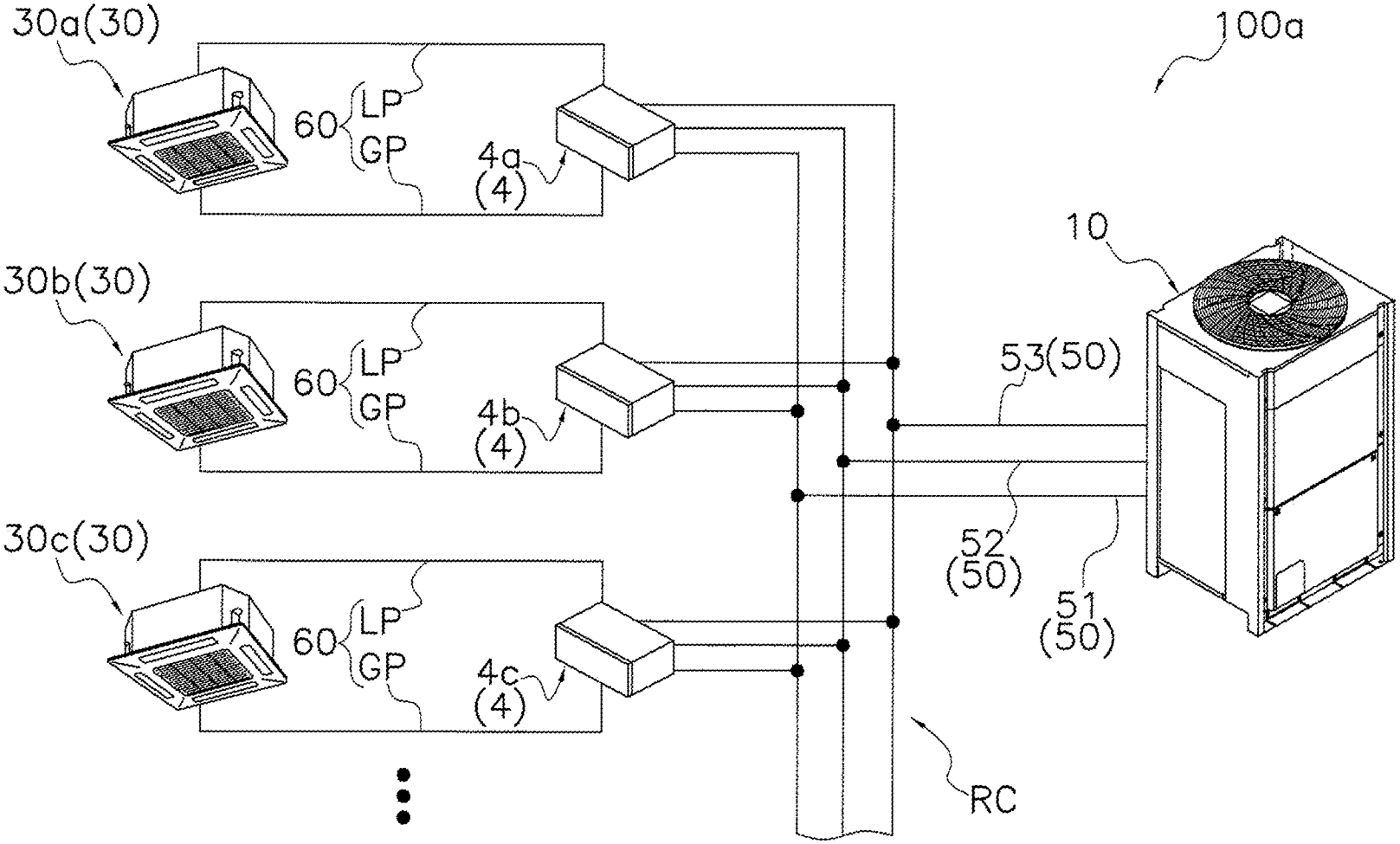
FIG. 8 is an overall configuration diagram of an air conditioning system according to a third modification example.
Figure 9:
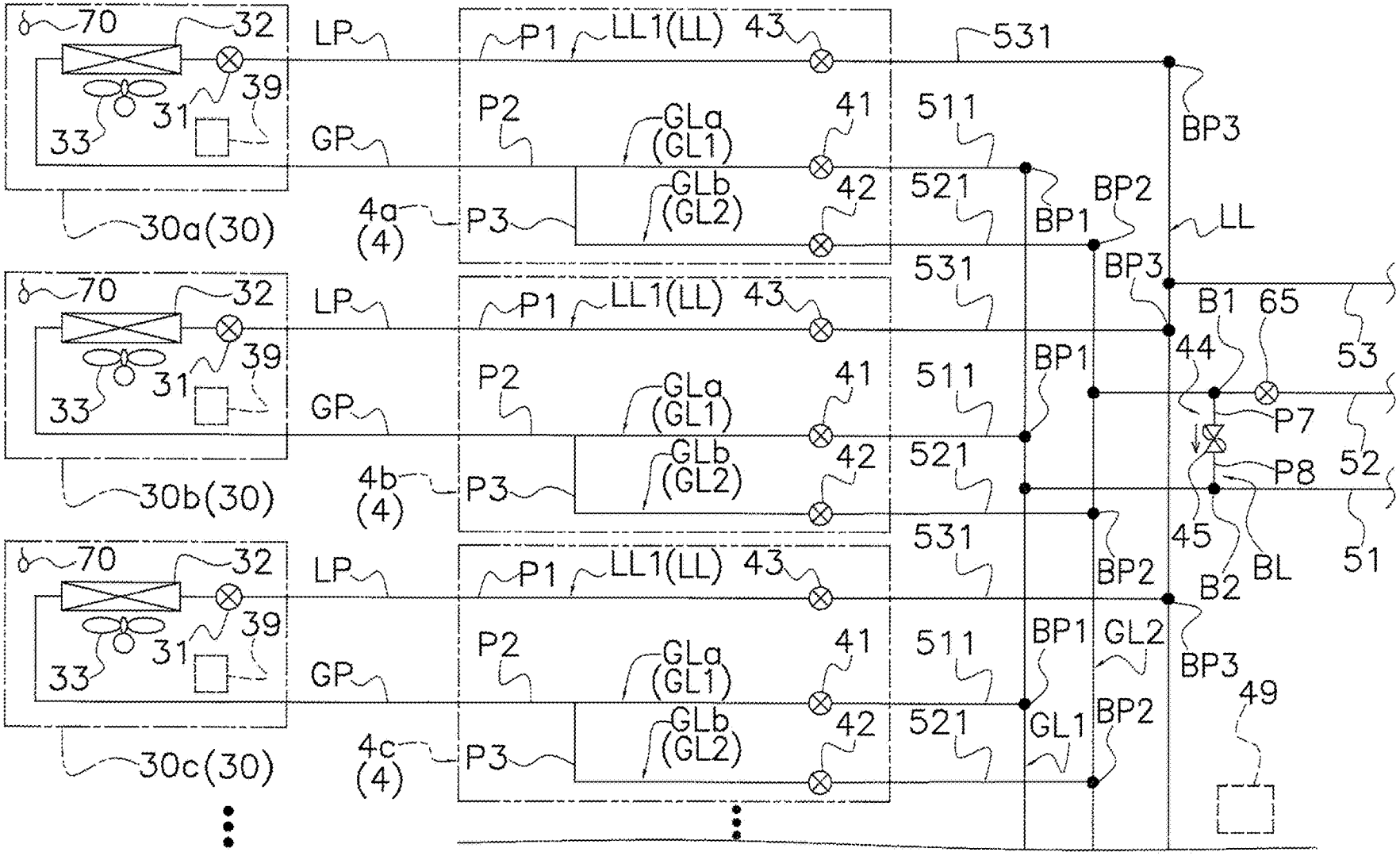
FIG. 9 is a diagram of a refrigerant circuit in indoor units and intermediate units according to the third modification example.

In the air conditioning system 100*a* illustrated in FIG. 8 and FIG. 9, unlike in the air conditioning system 100, the plurality of switching units 4 corresponding to the indoor units 30 on a one-to-one basis are separately disposed. Also in this case, an effect similar to that in the above-described embodiments can be realized.

(7-4) Fourth Modification Example

In the above-described embodiments, the gas-side blocking valve 65 is disposed in the intermediate unit 40. However, the gas-side blocking valve 65 need not necessarily be disposed in the intermediate unit 40, and may be disposed outside the intermediate unit 40.

(7-5) Fifth Modification Example

The indoor expansion valve 31 according to the above-described embodiments is not necessarily needed, but may be omitted as appropriate. In this case, the third control valve 43 may have a function of the indoor expansion valve 31 ("electric expansion valve"). Also in this case, the function and effect described in the above (6-1) can be realized.

(7-6) Sixth Modification Example

Although illustration is omitted, the third control valve 43 according to the above-described embodiments is not necessarily needed and may be omitted. In this case, a valve that is fully closed to block a flow of refrigerant in a closed state is adopted as the indoor expansion valve 31, and the indoor expansion valve 31 may have the function of the third control valve 43 ("second blocking valve").

(7-7) Seventh Modification Example

In the above-described embodiments, a description has been given of a case where the indoor expansion valve 31 is an electric valve that is in a slightly opened state to form a minute flow path when in a closed state (a minimum opening degree). However, the indoor expansion valve 31 may need not necessarily be such an expansion valve. That is, the indoor expansion valve 31 may be in a fully closed state to block a flow of refrigerant when having a minimum opening degree.

(7-8) Eighth Modification Example

In the above-described embodiments, a description has been given of a case where the second control valve 42 is an electric valve that is in a slightly opened state to form a minute flow path when in a closed state (a minimum opening degree). However, the second control valve 42 may need not necessarily be such an expansion valve. That is, the second control valve 42 may be in a fully closed state to block a flow of refrigerant when having a minimum opening degree.

(7-9) Ninth Modification Example

In the above-described embodiments, a description has been given of a case where the pressure adjusting valve 45 (corresponding to "bypass mechanism") is a mechanical automatic expansion valve including a pressure sensing mechanism in which a valve disc moves in accordance with a pressure higher than or equal to a pressure reference value applied to the one end side thereof. However, the pressure adjusting valve 45 may be another valve as long as the valve is capable of bypassing refrigerant in the second connection pipe 52. For example, the pressure adjusting valve 45 may be an electric expansion valve that is in a slightly opened state to form a minute flow path allowing refrigerant to pass therethrough when in a closed state. Also in this case, the refrigerant in the second connection pipe 52 is allowed to flow to the second bypass portion B2 via the minute flow path of the pressure adjusting valve 45.

(7-10) Tenth Modification Example

The pressure adjusting section 44 (the pressure adjusting valve 45 and the bypass flow path BL) according to the above-described embodiments is not necessarily needed and may be omitted as appropriate, from the viewpoint of reducing formation of a liquid seal circuit when the gas-side blocking valve 65 is controlled to a closed state.

(7-11) Eleventh Modification Example

In the above-described embodiments, a description has been given of a case where the first control valve 41, the second control valve 42, the third control valve 43, and the gas-side blocking valve 65 are electric valves whose opening degrees are adjustable. However, any one or all of the first control valve 41, the second control valve 42, the third control valve 43, and the gas-side blocking valve 65 may be an electromagnetic valve alternatively switched between an open state and a closed state when supplied with a drive voltage.

(7-12) Twelfth Modification Example

In the above-described embodiments, the plurality of flow-path switching valves 19 (the first flow-path switching valve 16, the second flow-path switching valve 17, and the third flow-path switching valve 18) are disposed, and each flow-path switching valve 19 is switched between the first flow-path state and the second flow-path state in accordance with an operation state, and accordingly the flow of refrigerant in the refrigerant circuit RC is switched. However, the embodiments are not limited thereto, and the flow of refrigerant in the refrigerant circuit RC may be switched by using another method.

For example, a three-way valve may be disposed instead of any one of the flow-path switching valves 19 (four-way switching valves). Alternatively, for example, a first valve (for example, an electromagnetic valve or an electric valve) and a second valve (for example, an electromagnetic valve or an electric valve) may be disposed instead of any one of the flow-path switching valves 19, so as to open the refrigerant flow path formed when the flow-path switching valve 19 is in the first flow-path state in the above-described embodiments by controlling the first valve to an open state and controlling the second valve to a fully closed state, and to open the refrigerant flow path formed when the flow-path switching valve 19 is in the second flow-path state in the above-described embodiments by controlling the first valve to a fully closed state and controlling the second valve to an open state.

(7-13) Thirteenth Modification Example

The circuit configuration of the refrigerant circuit RC and the devices disposed in the circuit in the above-described embodiments can be changed as appropriate in accordance with an installation environment or design specifications as long as the spiritual object according to one or more embodiments of the present invention is achieved. One or some of the devices may be omitted, another device may be newly added, or a new flow path may be included.

For example, the subcooling heat exchanger 27 disposed in the outdoor unit 10 is not necessarily needed and may be omitted. In addition, in the refrigerant circuit RC, a receiver for storing refrigerant may be disposed at an appropriate position (for example, in the liquid-side pipe Pc) as necessary. In addition, the refrigerant circuit RC may include a flow path not illustrated in FIG. 1 or FIG. 2 (for example, a flow path for injecting intermediate-pressure refrigerant into the compressor 15).

In addition, for example, the indoor expansion valve 31 need not necessarily be disposed in the indoor unit 30. In addition, the indoor expansion valve 31 is not necessarily needed. The indoor expansion valve 31 may be omitted by causing the third control valve 43 of the corresponding switching unit 4 to function as the indoor expansion valve 31.

(7-14) Fourteenth Modification Example

In the above-described embodiments, only one outdoor unit 10 is provided. Alternatively, a plurality of outdoor units 10 may be disposed in series or parallel to each indoor unit 30 or each switching unit 4.

(7-15) Fifteenth Modification Example

In the above-described embodiments, the outdoor unit control section 9, the indoor unit control section 39 of each indoor unit 30, and the intermediate unit control section 49 are connected by communication lines, and thereby the controller 80 that controls the operation of the air conditioning system 100 is formed. However, the configuration of the controller 80 is not necessarily limited thereto, and can be changed as appropriate in accordance with design specifications or an installation environment. That is, the configuration of the controller 80 is not limited. Some or all of the elements included in the controller 80 need not necessarily be disposed in any one of the outdoor unit 10, the indoor unit 30, and the intermediate unit 40, and may be disposed in another apparatus or may be disposed independently.

For example, in addition to/instead of any one or all of the outdoor unit control section 9, each indoor unit control section 39, and the intermediate unit control section 49, another apparatus such as a remote controller or a central management apparatus not illustrated may form the controller 80. In this case, the other apparatus may be disposed in a remote place connected to the outdoor unit 10, the indoor unit 30, or the intermediate unit 40 through a communication network.

In addition, for example, only any one of the outdoor unit control section 9, each indoor unit control section 39, and the intermediate unit control section 49 may constitute the controller 80.

(7-16) Sixteenth Modification Example

In the above-described embodiments, the controller 80 performs the first refrigerant leak control, the second refrigerant leak control, and the third refrigerant leak control when a refrigerant leak occurs (steps S105 to S108 in FIG. 5). However, among the control operations performed by the controller 80 when a refrigerant leak occurs, the first refrigerant leak control need not necessarily be performed. That is, the indoor expansion valve 31 need not necessarily be controlled to a closed state when a refrigerant leak occurs. That is, the first refrigerant leak control may be omitted as appropriate in a case where the second refrigerant leak control and the third refrigerant leak control block the flow of refrigerant to the refrigerant leak unit and reduce another refrigerant leak.

(7-17) Seventeenth Modification Example

In the above-described embodiments, when a refrigerant leak occurs, the controller 80 controls the third control valve 43 to a closed state in the second refrigerant leak control.

However, as long as the controller 80 performs the first refrigerant leak control (i.e., as long as the indoor expansion valve 31 is controlled to a closed state) at the time of a refrigerant leak, a flow of refrigerant into the refrigerant leak unit is reduced, and thus the controller 80 need not necessarily control the third control valve 43 to a closed state in the second refrigerant leak control.

(7-18) Eighteenth Modification Example

In the above-described embodiments, a description has been given of a case where the spirit according to one or more embodiments of the present invention is applied to the air conditioning system 100. However, the embodiments are not limited thereto, and the spirit according to one or more embodiments of the present invention is applicable to another refrigeration apparatus (for example, a water heater, a chiller, or the like) including a refrigerant circuit similar to the refrigerant circuit RC according to the above-described embodiments.

(7-19) Nineteenth Modification Example

In the above-described embodiments, R32 is used as an example of refrigerant that circulates in the refrigerant circuit RC. However, the refrigerant used in the refrigerant circuit RC is not limited. For example, in the refrigerant circuit RC, HFO1234yf, HFO1234ze(E), or mixed refrigerant of these types of refrigerant may be used instead of R32. In addition, in the refrigerant circuit RC, HFC refrigerant, such as R407C or R410A, may be used.

8

The present invention can be used in a refrigeration apparatus.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

4: switching unit
8: outdoor-side sensor
9: outdoor unit control section
10, 10': outdoor unit (heat source unit)
11: first gas-side shutoff valve
12: second gas-side shutoff valve
13: liquid-side shutoff valve
14: accumulator
15: compressor
16: first flow-path switching valve
17: second flow-path switching valve
18: third flow-path switching valve
20: outdoor heat exchanger (heat-source-side heat exchanger)
21: first outdoor heat exchanger
22: second outdoor heat exchanger
23: first outdoor control valve
24: second outdoor control valve
25: third outdoor control valve
26: fourth outdoor control valve
27: subcooling heat exchanger
28: outdoor fan
30: indoor unit (utilization unit)
31: indoor expansion valve (utilization-side control valve)
32: indoor heat exchanger (utilization-side heat exchanger)
33: indoor fan
38: indoor-side sensor
39: indoor unit control section
40, 40': intermediate unit (refrigerant-flow-path switching unit)
41: first control valve (second gas-side control valve)
42: second control valve (first gas-side control valve)
43: third control valve (liquid-side control valve)
44: pressure adjusting section
45: pressure adjusting valve (bypass mechanism)

48: receiver
49: intermediate unit control section
50: outdoor-side connection pipe
51: first connection pipe (second gas-side connection pipe)
52: second connection pipe (first gas-side connection pipe)
53: third connection pipe (liquid-side connection pipe)
60: indoor-side connection pipe
65: gas-side blocking valve (blocking valve)
70: refrigerant leak sensor (refrigerant leak detecting section)
80: controller (control section)
81: storage section
82: input control section
83: mode control section
84: refrigerant leak determining section
85: device control section
86: drive signal output section
100, 100*a*: air conditioning system
271: first flow path
272: second flow path
511: first branch pipe (second gas-side branch pipe)
521: second branch pipe (first gas-side branch pipe)
531: liquid-side branch pipe
B1: first bypass portion
B2, B2': second bypass portion (bypass portion)
BL, BL': bypass flow path
BP1: first gas-side branch portion
BP2: second gas-side branch portion (branch portion)
BP3: liquid-side branch portion
GL: gas-side refrigerant flow path
GL1: first gas-side refrigerant flow path
GL2: second gas-side refrigerant flow path
GLa: first gas-side branch flow path
GLb: second gas-side branch flow path
GP: gas-side connection pipe
IL: indoor-side refrigerant flow path
LL: liquid-side refrigerant flow path
LL1: liquid-side branch flow path
LP: liquid-side connection pipe
P1: first pipe
P2: second pipe
P3: third pipe
P7, P7': seventh pipe (bypass pipe)
P8, P8': eighth pipe (bypass pipe)
Pa: suction pipe
Pb: discharge pipe
Pc: liquid-side pipe
RC, RC1: refrigerant circuit

PATENT LITERATURE

PTL 1: Japanese Unexamined Patent Application Publication No. 2015-114048

The invention claimed is:

1. A refrigeration apparatus that performs a refrigeration cycle in a refrigerant circuit, comprising:
a heat source unit comprising:
a compressor for refrigerant; and
a heat-source-side heat exchanger;
utilization units that are connected to the heat source unit in parallel, wherein each of the utilization units comprises a utilization-side heat exchanger;
a refrigerant-flow-path switching unit that:
comprises first gas-side control valves, each of which switches a flow of refrigerant in a corresponding one of the utilization units, and
individually switches a flow of refrigerant in each of the utilization units;
a first gas-side connection piping disposed between the heat source unit and each of the first gas-side control valves and through which high-pressure gas refrigerant flows;
first gas-side branch pipes, each of which is included in the first gas-side connection piping and communicates with a corresponding one of the utilization units; and
a blocking valve disposed in the first gas-side connection piping and that blocks a flow of refrigerant when in a closed state, wherein
each of the first gas-side control valves is disposed in each of the first gas-side branch pipes that communicates with a corresponding one of the utilization units,
the first gas-side connection piping comprises branch portions connected to the first gas-side branch pipes,
the blocking valve is disposed between the heat source unit and each of the branch portions, and
each of the first gas-side control valves in a closed state allows refrigerant to pass therethrough but in a smaller amount than in an opened stated.

2. The refrigeration apparatus according to claim 1, wherein the blocking valve is disposed in the refrigerant-flow-path switching unit.

3. The refrigeration apparatus according to claim 1, further comprising:
a controller that controls an operation of the blocking valve; and
a refrigerant leak sensor that detects a refrigerant leak in the utilization units, wherein
in response to the refrigerant leak sensor detecting a refrigerant leak, the controller closes the blocking valve.

4. The refrigeration apparatus according to claim 3, further comprising:
a liquid-side connection piping that is disposed between the heat source unit and the utilization units and through which refrigerant in a liquid state flows;
liquid-side branch pipes, each of which is included in the liquid-side connection piping and communicates with a corresponding one of the utilization units; and
utilization-side control valves, each of which is disposed in one of the utilization units and communicates with one of the liquid-side branch pipes, wherein
in response to the refrigerant leak sensor detecting a refrigerant leak, the controller closes a corresponding one of the utilization-side control valves.

5. The refrigeration apparatus according to claim 3, further comprising:
a liquid-side connection piping that is disposed between the heat source unit and the utilization units and through which refrigerant in a liquid state flows; and
liquid-side branch pipes, each of which is included in the liquid-side connection piping and communicates with a corresponding one of the utilization units, wherein
the refrigerant-flow-path switching unit comprises liquid-side control valves each of which:
is disposed in one of the liquid-side branch pipes, and switches a flow of refrigerant in a corresponding one of the utilization units, and
in response to the refrigerant leak sensor detecting a refrigerant leak, the controller closes a corresponding one of the liquid-side control valves.

6. The refrigeration apparatus according to claim 3, wherein, in response to the refrigerant leak sensor detecting a refrigerant leak, the controller closes a corresponding one of the first gas-side control valves.

7. The refrigeration apparatus according to claim 3, further comprising:

a second gas-side connection piping that is disposed between the heat source unit and the refrigerant-flow-path switching unit and through which low-pressure gas refrigerant flows; and second gas-side branch pipes, each of which is included in the second gas-side connection piping and communicates with a corresponding one of the utilization units, wherein the refrigerant-flow-path switching unit comprises second gas-side control valves, each of which:

is disposed in one of the second gas-side branch pipes, and switches a flow of refrigerant in a corresponding one of the utilization units, and in response to the refrigerant leak sensor detecting a refrigerant leak, the controller closes a corresponding one of the second gas-side control valves.

8. A refrigeration apparatus that performs a refrigeration cycle in a refrigerant circuit, comprising:

a heat source unit comprising:

a compressor for refrigerant; and a heat-source-side heat exchanger;

utilization units that are connected to the heat source unit in parallel, wherein each of the utilization units comprises a utilization-side heat exchanger;

a refrigerant-flow-path switching unit that:

comprises first gas-side control valves, each of which switches a flow of refrigerant in a corresponding one of the utilization units, and individually switches a flow of refrigerant in each of the utilization units;

a first gas-side connection piping disposed between the heat source unit and each of the first gas-side control valves and through which high-pressure gas refrigerant flows;

first gas-side branch pipes, each of which is included in the first gas-side connection piping and communicates with a corresponding one of the utilization units;

a blocking valve disposed in the first gas-side connection piping and that blocks a flow of refrigerant when in a closed state;

a controller that controls an operation of the blocking valve;

a refrigerant leak sensor that detects a refrigerant leak in the utilization units;

a second gas-side connection piping that is disposed between the heat source unit and the refrigerant-flow-path switching unit and through which low-pressure gas refrigerant flows; and second gas-side branch pipes, each of which is included in the second gas-side connection piping and communicates with a corresponding one of the utilization units, wherein each of the first gas-side control valves is disposed in each of the first gas-side branch pipes that communicates with a corresponding one of the utilization units, the first gas-side connection piping comprises branch portions connected to the first gas-side branch pipes, the blocking valve is disposed between the heat source unit and each of the branch portions, in response to the refrigerant leak sensor detecting a refrigerant leak, the controller closes the blocking valve, the refrigerant-flow-path switching unit comprises second gas-side control valves, each of which:

is disposed in one of the second gas-side branch pipes, and switches a flow of refrigerant in a corresponding one of the utilization units, and in response to the refrigerant leak sensor detecting a refrigerant leak, the controller closes a corresponding one of the second gas-side control valves.

9. The refrigeration apparatus according to claim 8, wherein the blocking valve is disposed in the refrigerant-flow-path switching unit.

10. The refrigeration apparatus according to claim 8, further comprising:

a liquid-side connection piping that is disposed between the heat source unit and the utilization units and through which refrigerant in a liquid state flows;

liquid-side branch pipes, each of which is included in the liquid-side connection piping and communicates with a corresponding one of the utilization units; and utilization-side control valves, each of which is disposed in one of the utilization units and communicates with one of the liquid-side branch pipes, wherein in response to the refrigerant leak sensor detecting a refrigerant leak, the controller closes a corresponding one of the utilization-side control valves.

11. The refrigeration apparatus according to claim 8, further comprising:

a liquid-side connection piping that is disposed between the heat source unit and the utilization units and through which refrigerant in a liquid state flows; and liquid-side branch pipes, each of which is included in the liquid-side connection piping and communicates with a corresponding one of the utilization units, wherein the refrigerant-flow-path switching unit comprises liquid-side control valves, each of which:

is disposed in one of the liquid-side branch pipes, and switches a flow of refrigerant in a corresponding one of the utilization units, and in response to the refrigerant leak sensor detecting a refrigerant leak, the controller closes a corresponding one of the liquid-side control valves.

12. The refrigeration apparatus according to claim 8, wherein, in response to the refrigerant leak sensor detecting a refrigerant leak, the controller closes a corresponding one of the first gas-side control valves.

13. The refrigeration apparatus according to claim 8, further comprising a bypass valve that allows refrigerant in the first gas-side connection piping to flow to a bypass portion disposed in another pipe that communicates with the heat source unit.

14. The refrigeration apparatus according to claim 13, wherein the bypass valve is a pressure adjusting valve that is disposed in a bypass pipe extending from the first gas-side connection piping to the bypass portion and that opens the bypass pipe when refrigerant in the first gas-side connection piping has a pressure higher than or equal to a predetermined reference value.

15. A refrigeration apparatus that performs a refrigeration cycle in a refrigerant circuit, comprising:

a heat source unit comprising:

a compressor for refrigerant; and a heat-source-side heat exchanger;

utilization units that are connected to the heat source unit in parallel, wherein each of the utilization units comprises a utilization-side heat exchanger;

a refrigerant-flow-path switching unit that:

comprises first gas-side control valves, each of which switches a flow of refrigerant in a corresponding one of the utilization units, and individually switches a flow of refrigerant in each of the utilization units;

a first gas-side connection piping disposed between the heat source unit and each of the first gas-side control valves and through which high-pressure gas refrigerant flows;

first gas-side branch pipes, each of which is included in the first gas-side connection piping and communicates with a corresponding one of the utilization units;

a blocking valve disposed in the first gas-side connection piping and that blocks a flow of refrigerant when in a closed state; and a bypass valve that allows refrigerant in the first gas-side connection piping to flow to a bypass portion disposed in another pipe that communicates with the heat source unit, wherein each of the first gas-side control valves is disposed in each of the first gas-side branch pipes that communicates with a corresponding one of the utilization units, the first gas-side connection piping comprises branch portions connected to the first gas-side branch pipes, the blocking valve is disposed between the heat source unit and each of the branch portions, and the bypass valve is a pressure adjusting valve that is disposed in a bypass pipe extending from the first gas-side connection piping to the bypass portion and that opens the bypass pipe when refrigerant in the first gas-side connection piping has a pressure higher than or equal to a predetermined reference value.

16. The refrigeration apparatus according to claim 15, wherein the blocking valve is disposed in the refrigerant-flow-path switching unit.

17. The refrigeration apparatus according to claim 15, further comprising:

a controller that controls an operation of the blocking valve; and a refrigerant leak sensor that detects a refrigerant leak in the utilization units, wherein in response to the refrigerant leak sensor detecting a refrigerant leak, the controller closes the blocking valve.

18. The refrigeration apparatus according to claim 17, further comprising:

a liquid-side connection piping that is disposed between the heat source unit and the utilization units and through which refrigerant in a liquid state flows;

liquid-side branch pipes, each of which is included in the liquid-side connection piping and communicates with a corresponding one of the utilization units; and utilization-side control valves, each of which is disposed in one of the utilization units and communicates with one of the liquid-side branch pipes, wherein in response to the refrigerant leak sensor detecting a refrigerant leak, the controller closes a corresponding one of the utilization-side control valves.

19. The refrigeration apparatus according to claim 17, further comprising:

a liquid-side connection piping that is disposed between the heat source unit and the utilization units and through which refrigerant in a liquid state flows; and liquid-side branch pipes, each of which is included in the liquid-side connection piping and communicates with a corresponding one of the utilization units, wherein the refrigerant-flow-path switching unit comprises liquid-side control valves, each of which:

is disposed in one of the liquid-side branch pipes, and switches a flow of refrigerant in a corresponding one of the utilization units, and in response to the refrigerant leak sensor detecting a refrigerant leak, the controller closes a corresponding one of the liquid-side control valves.

20. The refrigeration apparatus according to claim 17, wherein, in response to the refrigerant leak sensor detecting a refrigerant leak, the controller closes a corresponding one of the first gas-side control valves.

* * * * *